US007709786B2

(12) United States Patent
Konenkov et al.

(10) Patent No.: US 7,709,786 B2
(45) Date of Patent: May 4, 2010

(54) METHOD OF OPERATING QUADRUPOLES WITH ADDED MULTIPOLE FIELDS TO PROVIDE MASS ANALYSIS IN ISLANDS OF STABILITY

(75) Inventors: Nikolai Konenkov, Ryazan (RU); Donald J. Douglas, Vancouver (CA); Xianzhen Zhao, Vancouver (CA)

(73) Assignee: The University of British Columbia, Vancouver (CA)

( * ) Notice: Subject to any disclaimer, the term of this patent is extended or adjusted under 35 U.S.C. 154(b) by 314 days.

(21) Appl. No.: 11/703,381

(22) Filed: Feb. 7, 2007

(65) Prior Publication Data

US 2007/0295900 A1 Dec. 27, 2007

Related U.S. Application Data

(60) Provisional application No. 60/771,258, filed on Feb. 7, 2006.

(51) Int. Cl.
*H01J 49/04* (2006.01)

(52) U.S. Cl. ..... 250/282; 250/281; 250/292

(58) Field of Classification Search ..... 250/281, 250/282, 283, 285, 287, 288, 290, 291, 292, 250/293, 294, 295, 296, 297
See application file for complete search history.

(56) References Cited

U.S. PATENT DOCUMENTS

| | | | | |
|---|---|---|---|---|
| 2,939,952 | A | 6/1960 | Paul et al. | |
| 5,177,359 | A * | 1/1993 | Hiroki et al. | 250/292 |
| 5,227,629 | A * | 7/1993 | Miseki | 250/292 |
| 6,897,438 | B2 | 5/2005 | Soudakov et al. | |
| 7,045,797 | B2 | 5/2006 | Sudakov et al. | |
| 7,141,789 | B2 | 11/2006 | Douglas et al. | |

(Continued)

FOREIGN PATENT DOCUMENTS

FR 2620568 A1 3/1989

(Continued)

OTHER PUBLICATIONS

Glebova et al., "Quadrupole Mass Filter Transmission in Island A of the First Stability Region with Quadrupolar Excitation", 2002, European Journal of Mass Spectrometry vol. 8, pp. 201-205.*

(Continued)

*Primary Examiner*—Jack I Berman
*Assistant Examiner*—Nicole Ippolito Rausch
(74) *Attorney, Agent, or Firm*—Lahive & Cockfield, LLP; Anthony A. Laurentano

(57) ABSTRACT

A method of processing ions in a quadrupole rod set is provided, comprising a) establishing and maintaining a two-dimensional substantially quadrupole field having a quadrupole harmonic with amplitude $A_2$ and a selected higher order harmonic with amplitude $A_m$ radially confining ions having Mathieu parameters a and q within a stability region defined in terms of the Mathieu parameters a and q; c) adding an auxiliary excitation field to transform the stability region into a plurality of smaller stability islands defined in terms of the Mathieu parameters a and q; and, d) adjusting the two-dimensional substantially quadrupole field to place ions within a selected range of mass-to-charge ratios within a selected stability island in the plurality of stability islands.

14 Claims, 29 Drawing Sheets

U.S. PATENT DOCUMENTS

| | | | | |
|---|---|---|---|---|
| 2004/0108456 | A1 * | 6/2004 | Sudakov et al. | 250/288 |
| 2005/0067564 | A1 | 3/2005 | Douglas et al. | |
| 2005/0263696 | A1 * | 12/2005 | Wells | 250/292 |

FOREIGN PATENT DOCUMENTS

WO WO2004013891 * 2/2004

OTHER PUBLICATIONS

Amad, Ma'an H. et al., "High-Resolution Mass Spectrometry with a Multiple Pass Quadrupole Mass Analyzer," *Anal. Chem.*, vol. 70:4885-4889 (1998).

Amad, Ma'an H. et at., "Mass Resolution of 11,000 to 22,000 With a Multiple Pass Quadrupole Mass Analyzer," *J. Am. Soc. Mass Spectrom.*, vol. 11:407-415 (2000).

Baranov, V.I. et al., "QMF Operation with Quadrupole Excitation," *Plasma Source Mass Spectrometry, The New Millennium*, pp. 63-72 (2001).

Dawson, Peter H., "The Mass Filter," Quadrupole Mass Spectrometry and its Applications, Elsevier Scientific Publishing Company, pp. 19-23 (1976).

Ding, Chuanfan et al., "Quadrupole mass filters with octopole fields," *Rapid Communications in Mass Spectrometry*, vol. 17:2495-2502 (2003).

Douglas, D.J. et al., "Collisional Focusing Effects in Radio Frequence Quadrupoles," *J. Am. Soc. Mass Spectrom.*, vol. 3:398-408 (1992).

Douglas, D.J. et al., "Influence of the 6th and 10th spatial harmonics on the peak shape of a quadrupole mass filter with round rods," *Rapid Communications in Mass Spectrometry*, vol. 16:1425-1431(2002).

Douglas, Donald J. et al., "Linear Ion Traps in Mass Spectrometry," *Mass Spectrometry Reviews*, vol. 24:1-29 (2005).

Douglas, D.J. et al., "Spatial harmonics of the field in a quadrupole mass filter with circular electrodes," *Zh. Tekh. Fiz.*, vol. 69:96-101 (1999).

Hairer, E. et al., "II.13. Numerical methods for second order differential equations," Solving Ordinary Differential Equations I, Nonstiff Problems, Springer-Verlag, pp. 260-275, 447-450 (1987).

Konenkov, N.V. et al., "Matrix Methods for the Calculation of Stability Diagrams in Quadrupole Mass Spectrometry," J. Am. Soc. Mass Spectrom., vol. 13:597-613 (2002).

Konenkov, N.V. et al., "Quadrupole mass filter operation with auxiliary quadrupolar excitation: theory and experiment," International Journal of Mass Spectrometry, vol. 208:17-27 (2001).

Konenkov, N.V. et al., "Upper Stability Island of the Quadrupole Mass Filter with Amplitude Modulation of the Applied Voltages," J. Am. Soc. Mass Spectrom., vol. 16:379-387 (2005).

McLachlam, N.W., "General Theory: Functions of Fractional Order: Solutions of Equations," Chapt. IV, pp. 57-103, "Hill's Equation," Chpt. VI, pp. 127-140, Theory and Application of Mathieu Functions (1947).

Moradian, Annie et al., "Experimental investigation of mass analysis using an island of stability with a quadrupole with 2.0% added octopole filed," Rapid Communications in Mass Spectrometry, vol. 21:3306-3310 (2007).

Moradian, Annie et al., "Mass Selective Axial Ion Ejection from Linear Quadrupoles with Added Octopole Fields," J. Am. Soc. Mass Spectrom., vol. 19(2):270-280 (2008).

Mori, Toshihiko et al., "Nonlinear Resonances of Laser Cooled Ions in a Linear Paul Trap due to the Anharmonicity of the Trap Potential," Laser Original, vol. 31(7):477-481 (2003).

Nayfeh, Ali Hasan et al., "Forced Oscillations of Systems Having a Single Degree of Freedom," Nonlinear Oscillations, John Wiley & Sons, Chpt. 4, pp. 161-195 (1979).

Smythe, W.B., "Two-Dimensional Potential Distributions," Static and Dynamic Electricity, Chpt. IV, pp. 63-66 (1989).

Sudakov, Michael et al., "Linear quadrupoles with added octopole fields," Rapid Communications in Mass Spectrometry, vol. 17:2290-2294 (2003).

Thomsen, Jon Juel, "3.4.4 Stability of Singular Points," Vibrations and Stability, Advanced Theory, Analysis, and Tools, 2nd Edition, Springer, pp. 77-91, 105-106 (2003).

Völlkopf, Uwe et al., "ICP-MS Multielement Analysis at SUB-PPT Levels Applying New Instrumental Design Concepts," Plasma Source Mass Spectrometry—New Developments and Applications, pp. 63-72 (1999).

Wentzel, E.S., "Probability Theory (first steps)," Mir Publishers, pp. 78-87 (1989).

Zhao, Xian Zhen et al., "Quadrupole Excitation of Ions in Linear Quadrupole Ion Traps with Added Octopole Fields," J. Am. Soc. Mass Spectrom., vol. 19(4):510-519 (2008).

Dawson, P.H., "Ion Optical Properties of Quadrupole Mass Filters," *Advances in Electronics and Electron Physics*, vol. 53:153-208 (1980).

Konenkov, Nikolai et al., "Linear Quadrupoles with Added Hexapole Fields," *J. Am. Soc. Mass Spectrom*, vol. 17:1063-1073 (2006).

Michaud, A.L. et al., "Ion Excitation in a Linear Quadrupole Ion Trap with an Added Octopole Field," *J. Am. Soc. Mass Spectrom*, vol. 16:835-849 (2005).

Titov, Vladimir V., "Ion separation in imperfect fields of the quadrupole mass analyser Part III. Transmission and optimal ion injection," *International Journal of Mass Spectrometry and Ion Processes*, vol. 14:37-43 (1995).

* cited by examiner

Prior Art

Prior Art

Ion separation in the upper stability island near the lower tip with auxiliary quadrupole excitation: $q'=0.020$, $\nu=\omega/\Omega=9/10$ and an added hexapole component $A_3=0.020$.

Comparison of peak shapes for a perfect quadrupole field (1) and for superposition (2) of quadrupole field ($A_2$=1.00) and hexapole field ($A_3$=0.020). 3 - separation at theupper tip with q. excit.($A_2$+$A_3$)

Mass analysis at the upper tip. (A2=1.0)+(A3=0.020). q'=0.020. ν=9/10. Peak shapes for different scan parameters λ.

q1=0.70731, q2=0.70746, $R_{0.5}$=7074/1.5=4716

Transmission contours for different values of the scan parameter λ.

Peak shapes with mass analysis at the lower tip of the island with q'=0.020, ν=9/10.

Fig. $A_3$=8%+q'=0.025

Fig. A3=8%+q'=0.025

Upper stability island with auxiliary rf excitation with parameters: $q'=0.025$, $\nu=9/10$, round rods, $r_x=r_y=1.1487$, $\theta=3.85^{0}$, $A_3=0.05943$.
U is the upper and L is the lower working tip. The boundary is determined at the 1% transmission level for n=150.

Location of the upper stability island SI in the a,q plane, created by rf auxiliary signal with parameters q'=0.025 and ν=9/10

METHOD OF OPERATING QUADRUPOLES WITH ADDED MULTIPOLE FIELDS TO PROVIDE MASS ANALYSIS IN ISLANDS OF STABILITY

RELATED APPLICATIONS

This application claims priority to U.S. Provisional Application No. 60/771,258 filed Feb. 7, 2006. The contents of the aforementioned application are hereby incorporated by reference.

FIELD

The invention relates in general to mass analysis, and more particularly relates to a method of mass analysis in a two-dimensional substantially quadrupole field with added higher multipole harmonics.

INTRODUCTION

The use of quadrupole electrode systems in mass spectrometers is known. For example, U.S. Pat. No. 2,939,952 (Paul et al.) (hereinafter "reference [1]") describes a quadrupole electrode system in which four rods surround and extend parallel to a quadrupole axis. Opposite rods are coupled together and brought out to one of two common terminals. Most commonly, an electric potential $V(t)=+(U-V_{rf}\cos \Omega t)$ is then applied between one of these terminals and ground and an electric potential $V(t)=-(U-V_{rf}\cos \Omega t)$ is applied between the other terminal and ground. In these formulae, U is a DC voltage, pole to ground, $V_{rf}$ is a zero to peak AC voltage, pole to ground, $\Omega$ is the angular frequency of the AC, and t is time. The AC component will normally be in the radio frequency (RF) range, typically about 1 MHz.

In constructing a linear quadrupole, the field may be distorted so that it is not an ideal quadrupole field. For example round rods are often used to approximate the ideal hyperbolic shaped rods required to produce a perfect quadrupole field. The calculation of the potential in a quadrupole system with round rods can be performed by the method of equivalent charges—see, for example, Douglas, D. J.; Glebova, T.; Konenkov, N.; Sudakov, M. Y. "Spatial Harmonics of the Field in a Quadrupole Mass Filter with Circular Electrodes", Technical Physics, 1999, 44, 1215-1219 (hereinafter "reference [2]"). When presented as a series of harmonic amplitudes $A_0, A_1, A_2 \ldots A_n$, the potential in a linear quadrupole can be expressed as follows:

$$\phi(x, y, z, t) = V(t) \times \phi(x, y) = V(t)\sum_N A_N \phi_N(x, y) \tag{1}$$

Field harmonics $\phi_N$, which describe the variation of the potential in the X and Y directions, can be expressed as follows:

$$\phi_N(x, y) = \text{Real}\left[\left(\frac{x+iy}{r_0}\right)^N\right] \tag{2}$$

where Real [(f(x+iy)] is the real part of the complex function f(x+iy). For example:

$$A_0\phi_0(x, y) = A_0\text{Real}\left[\left(\frac{x+iy}{r_0}\right)^0\right] = A_0 \text{ Constant potential} \tag{3}$$

$$A_1\phi_1(x, y) = A_1\text{Real}\left[\left(\frac{x+iy}{r_0}\right)^1\right] = \frac{A_1 x}{r_0} \text{ Dipole potential} \tag{3.1}$$

$$A_2\phi_2(x, y) = A_2\text{Real}\left[\left(\frac{x+iy}{r_0}\right)^2\right] = A_2\left(\frac{x^2-y^2}{r_0^2}\right)\text{Quadrupole} \tag{4}$$

$$A_3\phi_3(x, y) = A_3\text{Real}\left[\left(\frac{x+iy}{r_0}\right)^3\right] = A_3\left(\frac{x^3-3xy^2}{r_0^3}\right)\text{Hexapole} \tag{5}$$

$$A_4\phi_4(x, y) = A_4\text{Real}\left[\left(\frac{x+iy}{r_0}\right)^4\right] = A_4\left(\frac{x^4-6x^2y^2+y^4}{r_0^4}\right)\text{Octopole} \tag{6}$$

In these definitions, the X direction corresponds to the direction toward an electrode in which the potential $A_N$ increases to become more positive when V(t) is positive.

As shown above, $A_0\ \phi_0$ is the constant potential component of the field (i.e. independent of X and Y), $A_1\ \phi_1$ is the dipole potential, $A_2\ \phi_2$ is the quadrupole component of the field, $A_3\ \phi_3$ is the hexapole component of the field, $A_4\ \phi_4$ is the octopole component of the field, and there are still higher order components of the field, although in a practical quadrupole the amplitudes of the higher order components are typically small compared to the amplitude of the quadrupole term.

In a quadrupole mass filter, ions are injected into the field along the axis of the quadrupole. In general, the field imparts complex trajectories to these ions, which trajectories can be described as either stable or unstable. For a trajectory to be stable, the amplitude of the ion motion in the planes normal to the axis of the quadrupole must remain less than the distance from the axis to the rods ($r_0$). Ions with stable trajectories will travel along the axis of the quadrupole electrode system and may be transmitted from the quadrupole to another processing stage or to a detection device. Ions with unstable trajectories will collide with a rod of the quadrupole electrode system and will not be transmitted.

The motion of a particular ion is controlled by the Mathieu parameters a and q of the mass analyzer. For positive ions, these parameters are related to the characteristics of the potential applied from terminals to ground as follows:

$$a_x = -a_y = a = \frac{8eU}{m_{ion}\Omega^2 r_0^2} \text{ and } q_x = -q_y = \frac{4eV_{rf}}{m_{ion}\Omega^2 r_0^2} \tag{7}$$

where e is the charge on an ion, $m_{ion}$ is the ion mass, $\Omega=2\pi f$ where f is the AC frequency, U is the DC voltage from pole to ground and $V_{rf}$ is the zero to peak AC voltage from each pole to ground. If the potentials are applied with different voltages between pole pairs and ground, then in equation (7) U and V are ½ of the DC potential and the zero to peak AC potential respectively between the rod pairs. Combinations of a and q which give stable ion motion in both the X and Y directions are usually shown on a stability diagram.

With operation as a mass filter, the pressure in the quadrupole is kept relatively low in order to prevent loss of ions by scattering by the background gas. Typically the pressure is less than $5\times10^{-4}$ torr and preferably less than $5\times10^{-5}$ torr. More generally quadrupole mass filters are usually operated in the pressure range $1\times10^{-6}$ torr to $5\times10^{-4}$ torr. Lower pressures can be used, but the reduction in scattering losses below $1\times10^{-6}$ torr are usually negligible.

As well, when linear quadrupoles are operated as a mass filter the DC and AC voltages (U and V) are adjusted to place ions of one particular mass to charge ratio just within the tip of a stability region. Normally, ions are continuously introduced at the entrance end of the quadrupole and are continuously detected at the exit end. Ions are not normally confined within the quadrupole by stopping potentials at the entrance and exit. An exception to this is shown in the papers Ma'an H. Amad and R. S. Houk, "High Resolution Mass Spectrometry With a Multiple Pass Quadrupole Mass Analyzer", *Analytical Chemistry,* 1998, Vol. 70, 4885-4889 (hereinafter "reference [3]"), and Ma'an H. Amad and R. S. Houk, "Mass Resolution of 11,000 to 22,000 With a Multiple Pass Quadrupole Mass Analyzer", *Journal of the American Society for Mass Spectrometry,* 2000, Vol. 11, 407-415 (hereinafter "reference [4]"). These papers describe experiments where ions were reflected from electrodes at the entrance and exit of the quadrupole to give multiple passes through the quadrupole to improve the resolution. Nevertheless, the quadrupole was still operated at low pressure, although this pressure is not stated in these papers, and with the DC and AC voltages adjusted to place the ions of interest at the tip of the first stability region.

SUMMARY

In accordance with an aspect of an embodiment of the invention, there is provided a method of processing ions in a quadrupole rod set, the method comprising a) establishing and maintaining a two-dimensional substantially quadrupole field for processing the ions, the field having a quadrupole harmonic with amplitude $A_2$ and a selected higher order harmonic with amplitude $A_m$ wherein m is an integer greater than 2, and the magnitude of $A_m$ is greater than 0.1% of the magnitude of $A_2$;

b) introducing the ions to the two-dimensional substantially quadrupole field and subjecting the ions to both the quadrupole harmonic and the higher order harmonic of the field to radially confine ions having Mathieu parameters a and q within a stability region defined in terms of the Mathieu parameters a and q;

c) adding an auxiliary excitation field to transform the stability region into a plurality of smaller stability islands defined in terms of the Mathieu parameters a and q; and, d) adjusting the two-dimensional substantially quadrupole field including the auxiliary excitation field to place ions within a selected range of mass-to-charge ratios within a selected stability island in the plurality of stability islands to impart stable trajectories to the selected ions within the selected range of mass-to-charge ratios for transmission through the rod set, and to impart unstable trajectories to unselected ions outside of the selected range of mass-to-charge ratios to filter out such ions.

In various embodiments, the magnitude of $A_m$ is i) greater than 1% and is less than 20% of the magnitude of $A_2$; and, ii) greater than 1% and is less than 10% of the magnitude of $A_2$.

These and other features of the applicant's teachings are set forth herein.

BRIEF DESCRIPTION OF THE DRAWINGS

The skilled person in the art will understand that the drawings, described below, are for illustration purposes only. The drawings are not intended to limit the scope of the applicant's teachings in anyway.

FIG. 22 shows mass analysis at the tip, having the highest magnitude of the stability parameter a, when a<0, of the stability island having the highest magnitude of the stability parameter a.

FIG. 23 shows peak shapes at the tip, having the lowest magnitude of the stability parameter a, when a<0, of the stability island, having the highest magnitude of the stability parameter a.

DESCRIPTION OF VARIOUS EMBODIMENTS

Figure 1:
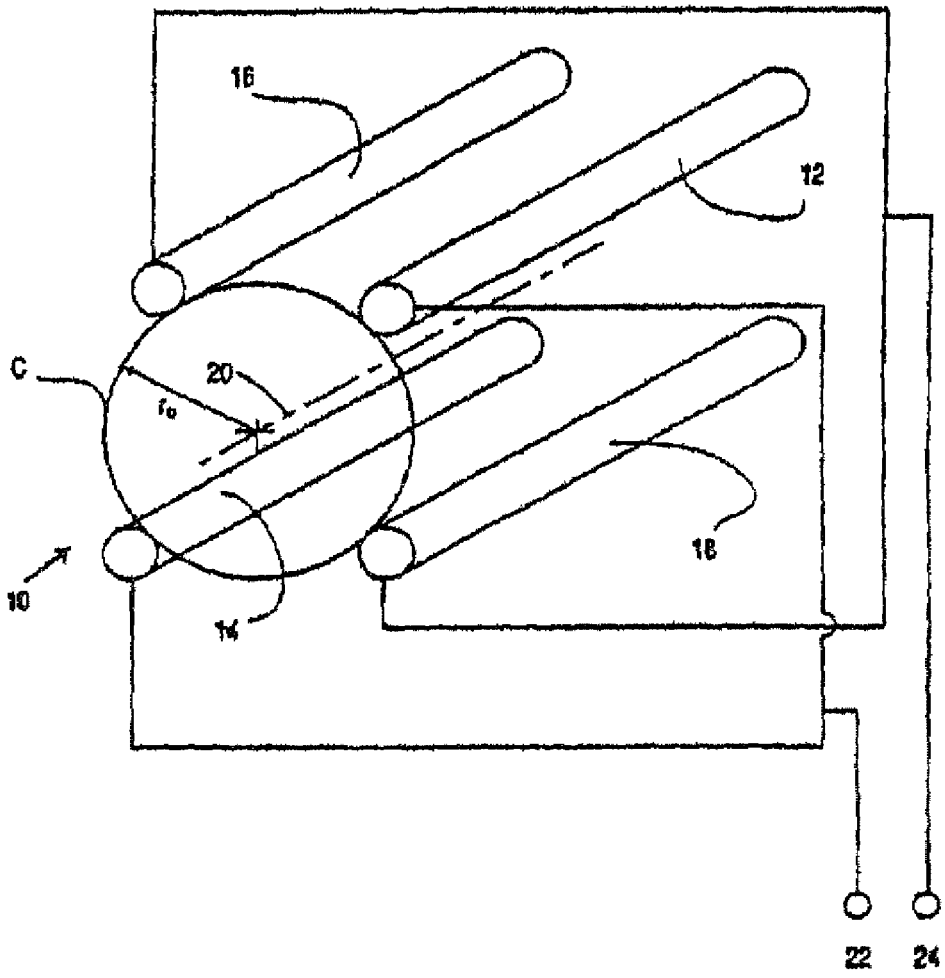
FIG. 1, in a schematic perspective view, illustrates a set of quadrupole rods.

Referring to FIG. 1, there is illustrated a quadrupole rod set 10 according to the prior art. Quadrupole rod set 10 comprises rods 12, 14, 16 and 18. Rods 12, 14, 16 and 18 are arranged symmetrically around axis 20 such that the rods have an inscribed circle C having a radius $r_0$. The cross sections of rods 12, 14, 16 and 18 are ideally hyperbolic and of infinite extent to produce an ideal quadrupole field, although rods of circular cross-section are commonly used. As is conventional, opposite rods 12 and 14 are coupled together and brought out to a terminal 22 and opposite rods 16 and 18 are coupled together and brought out to a terminal 24. An electrical potential $V(t)=+(U-V_{rf}\cos \Omega t)$ is applied between terminal 22 and ground and an electrical potential $V(t)=-(U-V_{rf}\cos \Omega t)$ is applied between terminal 24 and ground. When operating conventionally as a mass filter, as described below, for mass resolution, the potential applied has both a DC and AC component. For operation as a mass filter or an ion trap, the potential applied is at least partially-AC. That is, an AC potential will always be applied, while a DC potential will often, but not always, be applied. As is known, in some cases just an AC voltage is applied. The rod sets to which the positive DC potential is coupled may be referred to as the positive rods and those to which the negative DC potential is coupled may be referred to as the negative rods.

Figure 2:
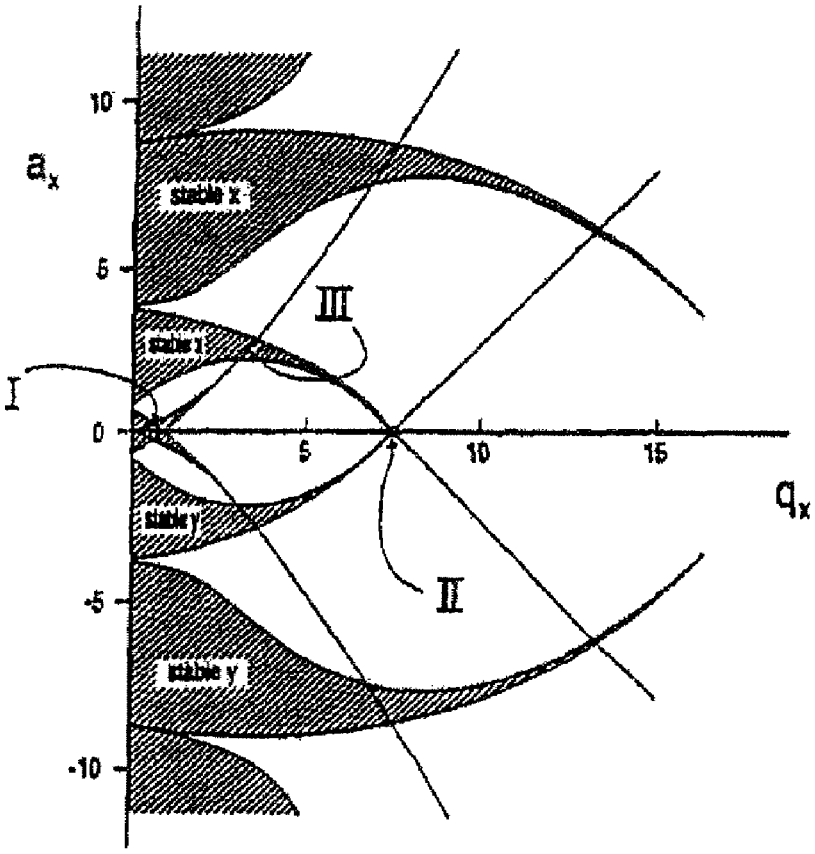
FIG. 2, in a stability diagram, illustrates combinations of Mathieu parameters a and q that provide stable ion motion in both the X and Y directions.

As described above, the motion of a particular ion is controlled by the Mathieu parameters a and q of the mass analyzer. These parameters are related to the characteristics of the potential applied from terminals 22 and 24 to ground as follows:

$$a_x = -a_y = a = \frac{8eU}{m_{ion}\Omega^2 r_0^2} \text{ and } q_x = -q_y = \frac{4eV_{rf}}{m_{ion}\Omega^2 r_0^2} \tag{7}$$

where e is the charge on an ion, $m_{ion}$ is the ion mass, $\Omega=2\pi f$ where f is the AC frequency, U is the DC voltage from a pole to ground and $V_{rf}$ is the zero to peak AC voltage from each pole to ground. Combinations of a and q which give stable ion motion in both the X and Y directions are shown on the stability diagram of FIG. 2. The notation of FIG. 2 for the regions of stability is taken from P. H. Dawson ed., "Quadrupole Mass Spectrometry and Its Applications", *Elsevier*, Amsterdam, 1976 (hereinafter "reference [5]"), pages 19-23. The "first" stability region refers to the region near (a,q)=(0.2, 0.7), the "second" stability region refers to the region near (a,q)=(0.02, 7.55) and the "third" stability region refers to the region near (a,q)=(3,3). It is important to note that there are many regions of stability (in fact an unlimited number). Selection of the desired stability regions, and selected tips or operating points in each region, will depend on the intended application.

Ion motion in a direction u in a quadrupole field can be described by the equation $$u(\xi) = A\sum_{n=-\infty}^{\infty} C_{2n}\cos[(2n+\beta)\xi] + B\sum_{n=-\infty}^{\infty} C_{2n}\sin[(2n+\beta)\xi] \tag{8}$$

where $$\xi = \frac{\Omega t}{2}$$

and t is time, $C_{2n}$ depend on the values of a and q, and A and B depend on the ion initial position and velocity (see, for example, R. E. March and R. J. Hughes, "Quadrupole Storage Mass Spectrometry", John Wiley and Sons, Toronto, 1989, page 41 (hereinafter "reference [6]"). The value of β determines the frequencies of ion oscillation, and β is a function of the a and q values (see page 70 of reference [5]). From equation 8, the angular frequencies of ion motion in the X ($\omega_x$) and Y ($\omega_y$) directions in a two-dimensional quadrupole field are given by $$\omega_x = (2n+\beta_x)\frac{\Omega}{2} \tag{9}$$

$$\omega_y = (2n+\beta_y)\frac{\Omega}{2} \tag{10}$$

where n=0, ±1, ±2, ±3 . . . , $0 \leqq \beta_x \leqq 1$, $0 \leqq \beta_y \leqq 1$, in the first stability region and $\beta_x$ and $\beta_y$ are determined by the Mathieu parameters a and q for motion in the X and Y directions respectively (equation 7).

As described in U.S. Pat. No. 6,897,438 (Soudakov et al.); U.S. Patent Publication No. 2005/0067564 (Douglas et al.); and U.S. Patent Publication No. 2004/0108456 (Sudakov et al.) two-dimensional quadrupole fields used in mass spectrometers can be improved at least for some applications by adding higher order harmonics such as hexapole or octopole harmonics to the field. As described in these references, the hexapole and octopole components added to these fields will typically substantially exceed any octopole or hexapole components resulting from manufacturing or construction errors, which are typically well under 0.1%. For example, a hexapole component $A_3$ can typically be in the range of 1 to 6% of $A_2$, and may be as high as 20% of $A_2$ or even higher. Octopole components $A_4$ of similar magnitude may also be added.

As described in U.S. Patent Publication No. 2005/0067564, the contents of which are hereby incorporated by reference, a hexapole field can be provided to a two-dimensional substantially quadrupole field by providing suitably shaped electrodes or by constructing a quadrupole system in which the two-Y rods have been rotated in opposite directions to be closer to one of the X rods than to the other of the X rods. Similarly, as described in U.S. Pat. No. 6,897,438, the contents of which are hereby incorporated by reference, an octopole field can be provided by suitably shaped electrodes, or by constructing the quadrupole system to have a 90° asymmetry, by, for example, making the Y rods larger in diameter than the X rods.

It is also possible, as described in U.S. Patent Publication No. 2005/0067564 to simultaneously add both hexapole and octopole components by both rotating one pair of rods towards the other pair of rods, while simultaneously changing the diameter of one pair of rods relative to the other pair of rods. This can be done in two ways. The larger rods can be rotated toward one of the smaller rods, or the smaller rods can be rotated toward one of the larger rods.

Figure 3:
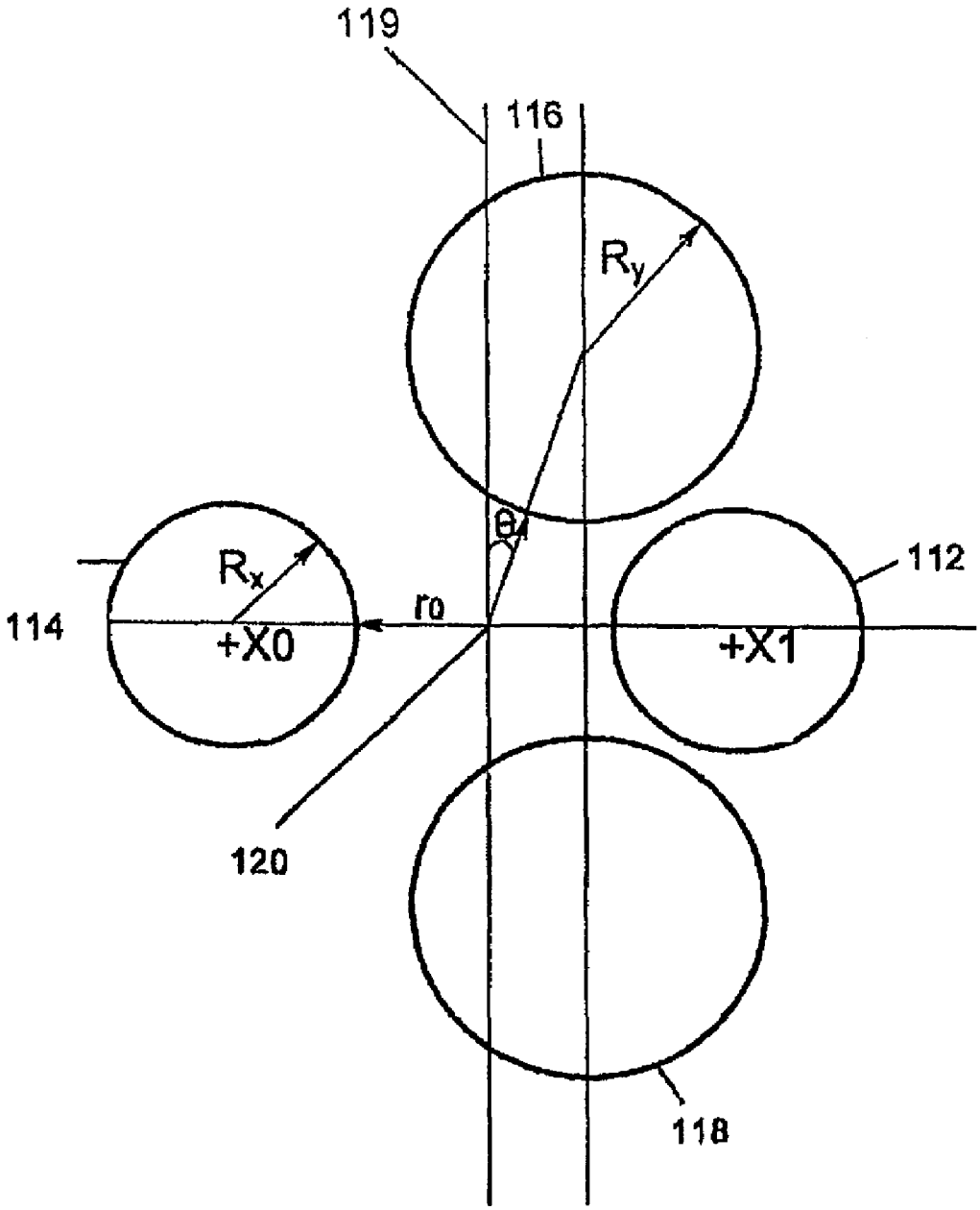
FIG. 3, in a sectional view, illustrates a set of quardrupole rods in which the Y rods have been rotated toward one of the X rods to add a hexapole harmonic to the substantially quadrupole field.

Referring to FIG. 3, there is illustrated in a sectional view, a set of quadrupole rods including Y rods that have undergone such rotation through an angled θ. The set of quadrupole rods includes X rods 112 and 114, Y rods 116 and 118, and quadrupole axis 120. The Y rods have radius $r_y$ and the X rods have radius $R_x$. All rods are a distance $r_0$ from the central axis 120 and $R_x=r_0$, although other values of $R_x$ can be used. The radius of the Y rods is greater than the radius of the X rods ($R_y>R_x$). When the Y rods are rotated toward the X rods, a dipole potential of amplitude $A_1$ is created. This can be removed by increasing the magnitude of the voltage on X rod 112 relative to the magnitude of the voltage applied to the X rod 114 and Y rods 116 and 118.

When round rods are used to add a hexapole or octopole harmonic to a two-dimensional substantially quadrupole field, the resolution, transmission and peak shape obtained in mass analysis may be degraded. Nonetheless, the addition of hexapole and octopole components to the field, and possibly other higher order multipoles, remains desirable for enhancing fragmentation and otherwise increasing MS/MS efficiency, as well as peak shape and ion excitation for MS/MS or for ion ejection. However, in some instruments, it is important that a linear quadrupole trap that is used for MS/MS also be capable of being operated as a mass filter. This can be made possible by adding an auxiliary quadrupole excitation to form islands of stability in the conventional stability diagram.

Islands of Stability

When an auxiliary quadrupole excitation waveform is applied to a quadrupole, ions that have oscillation frequencies that are resonant with the excitation are ejected from the quadrupole. Unstable regions corresponding to iso-β lines are formed in the stability diagram. The formation of such lines by auxiliary quadrupole excitation is described in Miseki, K. "Quadrupole Mass Spectrometer", U.S. Pat. No. 5,227,629, Jul. 13, 1993 (hereinafter "reference [7]"), Devant, G.; Fercocq, P.; Lepetit, G.; Maulat, O. "Patent No. Fr. 2,620,568" (hereinafter "reference [8]"), Konenkov, N. V.; Cousins, L. M.; Baranov, V. I.; Sudakov, M. Yu. "Quadrupole Mass Filter Operation with Auxiliary Quadrupole Excitation: Theory and Experiment", *Int. J. Mass Spectrom.* 2001, 208, 17-27 (hereinafter "reference [9]"), Baranov, V. I.; Konenkov, N. V.; Tanner, S. D.; "QMF Operation with Quadrupole Excitation", in *Plasma Source Mass Spectrometry in the New Millennium*; Holland G; Tanner, S. D., Eds.; Royal Society of Chemistry: Cambridge, 2001; 63-72 (hereinafter "reference [10]"), and Konenkov, N. V.; Sudakov, M. Yu.; Douglas D. J. "Matrix Methods for the Calculation of Stability Diagrams in Quadrupole Mass Spectrometry", *J. Am. Soc. Mass Spectrom.* 2002, 13, 597-613 (hereinafter "reference [11]"), and by modulation of the rf, dc or rf and dc voltages described in Konenkov, N. V.; Korolkov, A. N.; Machmudov, M. "Upper Stability Island of the Quadrupole Mass Filter with Amplitude Modulation of the Applied Voltage", *J. Am. Soc. Mass Spectrom.* 2005, 16, 379-387 (hereinafter "reference [12]"). With quadrupole excitation at a frequency ωx=(N/M)Ω, where N and M are integers, bands of instability are formed on the stability diagram, and the diagram splits or changes into islands of stability (see, for example, FIGS. 1 and 4 of reference [9]). The tips of these islands can then be used to perform mass analysis.

Mass Analysis with Cuadrupoles with Added Hexapole or Octopole Fields Using Islands of Stability Computer simulations have been done to evaluate the performance of quadrupole mass filters with added hexapole fields when operated at the upper and lower tips of the uppermost stability island (that is, the island having the highest magnitude values of the Mathieu parameter a formed with quadrupole excitation. This has been done to compare mass filters that have (i) ideal quadrupole fields, (ii) quadrupole fields with an added hexapole field but no higher multipoles ($A_2$ and $A_3$ only), (iii) quadrupoles constructed with round rods with radii $R_x \neq R_y$ so that $A_4 \approx 0$ and operated so that the dipole term is zero, and (iv) quadrupoles constructed with round rods of equal diameter so that $A_4 \neq 0$ but operated so that the dipole amplitude $A_1=0$. Simulations have also been done for quadrupoles that have added octopole fields, constructed with the Y rods greater in diameter than the X rods.

Definitions of Variables $$\pm(U - V_{rf}\cos\Omega t) \text{ applied voltage} \tag{11}$$

$$a = \frac{8eU}{mr_0^2\Omega^2} \text{ and } q = \frac{4eV_{rf}}{mr_0^2\Omega^2} \tag{7}$$

$$a/q = 2\lambda = \frac{2U}{V_{rf}} \tag{12}$$

$$\pm V'\cos\omega x t \text{ excitation voltage} \tag{13}$$

$$q' = q\frac{V'}{V_{rf}} \tag{14}$$

$$v = \frac{\omega x}{\Omega} = \frac{N}{M} \tag{15}$$

Calculation Methods

In general, as described above a two dimensional time-dependent electric potential can be expanded in multipoles as $$\phi(x, y, z, t) = V(t)\times\phi(x, y) = V(t)\sum_N A_N\phi_N(x, y) \tag{1}$$

where $A_N$ is the dimensionless amplitude of the multipole $\phi_N(x,y)$ and $\phi(t)$ is a time dependent voltage applied to the electrodes, as described in Smythe, W. R. "Static and Dynamic Electricity", *McGraw-Hill Book Company*, New York, 1939 (hereinafter "reference [13]"). For a quadrupole mass filter, $\phi(t)=U-V_{rf}\cos\Omega t$. Without loss of generality, for $N\geqq 1$, $\phi_N(x,y)$ can be calculated from $$\phi_N(x, y) = \mathrm{Re}\left[\frac{x+iy}{r_0}\right]^N \tag{2}$$

where Re[(f(ζ)] means the real part of the complex function f(ζ), ζ=x+iy, and $i^2=-1$. For rod sets with round rods, amplitudes of multipoles given by eq 2 were calculated with the method of effective charges, as described in reference [2].

Ion Source Model

Collisional cooling of ions in an RF quadrupole (or other multipole) has become a common method of coupling atmospheric pressure ion sources such as electrospray ionization (ESI) to mass analyzers, as described in Douglas, D. J.; French, J. B. "Collisional Focusing Effects in Radio Frequency Quadrupoles", *J. Am. Soc. Mass Spectrom.* 1992, 3, 398-40. and Douglas, D. J.; Frank, A. J.; Mao, D. "Linear Ion Traps in Mass Spectrometry", *Mass Spec.* Rev. 2005, 24, 1-29 (hereinafter "reference [14a] and [14b] respectively"). Collisions with background gas thermalize ions and concentrate ions near the quadrupole axis. We use an approximate model of a thermalized distribution of ions as the source for calculations of peak shapes and stability diagrams. At the input of the quadrupole, the ion spatial distribution can be approximated as a Gaussian distribution with the probability density function f(x,y)

$$f(x, y) = \frac{1}{2\pi\sigma_x^2} e^{-\left(\frac{x^2+y^2}{2\sigma_x^2}\right)} \tag{16}$$

where $\sigma_x$ determines the spatial spread.

Modeling initial ion coordinates X and Y with a random distribution given by eq 16 is based on the central limit theorem as described in Venttsel E. S. "Probability Theory". *Mir Publishers*, Moscow. 1982. p. 303 (hereinafter "reference [15]") for uniformly distributed values $x_i$ and $y_i$ on the interval $[-r_0, r_0]$ or dimensionless variables on the interval [−1, 1]. The distribution of eq 16 can be generated from $$x = \sqrt{\frac{3}{m}}\,\sigma_x \sum_{i=1}^{m} x_i;\; y = \sqrt{\frac{3}{m}}\,\sigma_y \sum_{i=1}^{m} y_i \tag{17}$$

where m is the number of random numbers $x_i$ and $y_i$ generated by a computer. In our calculations m=100. The standard deviations $\sigma_x$ and $\sigma_y$ determine the radial size of the ion beam.

The initial ion velocities in the x and y directions, $v_x$ and $v_y$ respectively, are taken from a thermal distribution given by $$g(v_x, v_y) = \frac{1}{2\pi\sigma_v^2} e^{-\left(\frac{m(v_x^2+v_y^2)}{2kT}\right)} \tag{18}$$

where $$\sigma_v = \sqrt{\frac{2kT}{m}}$$

is ion velocity dispersion, k is Boltzmann's constant, T is the ion temperature, m is the ion mass. Transverse velocities in the interval $[-3\sigma_v, 3\sigma_v]$ were used for every initial position. The dimensionless variables $$\xi = \frac{\Omega t}{2}$$

and $$u = \frac{x}{r_0}$$

are used in the ion motion equations. Then $$\frac{du}{d\xi} = \frac{dx}{dt}\frac{1}{\pi r_0 f} = \frac{v_x}{\pi r_0 f}$$

and

-continued $$f = \frac{\Omega}{2\pi}.$$

The dimensionless velocity dispersion $\sigma_u$ is $$\sigma_u = \frac{\sigma_v}{\pi r_0 f} = \frac{\sqrt{\frac{2kT}{m}}}{\pi r_0 f} = \frac{1}{\pi r_0 f}\sqrt{\frac{2RT}{M}} \tag{19}$$

where R is the gas constant, and M is the ion mass in Daltons. For typical conditions: M=390 Da, $r_0=5\times10^{-3}$ m, $f=1.0\times10^6$ Hz, and T=300K, eq 19 gives $\sigma_u=\sigma_v/\pi r_0 f=0.0072$. The ion velocity dispersion $\sigma_v$ decreases with M as $M^{-1/2}$. This helps to improve the transmission of a quadrupole mass filter at higher mass.

Figure 4:
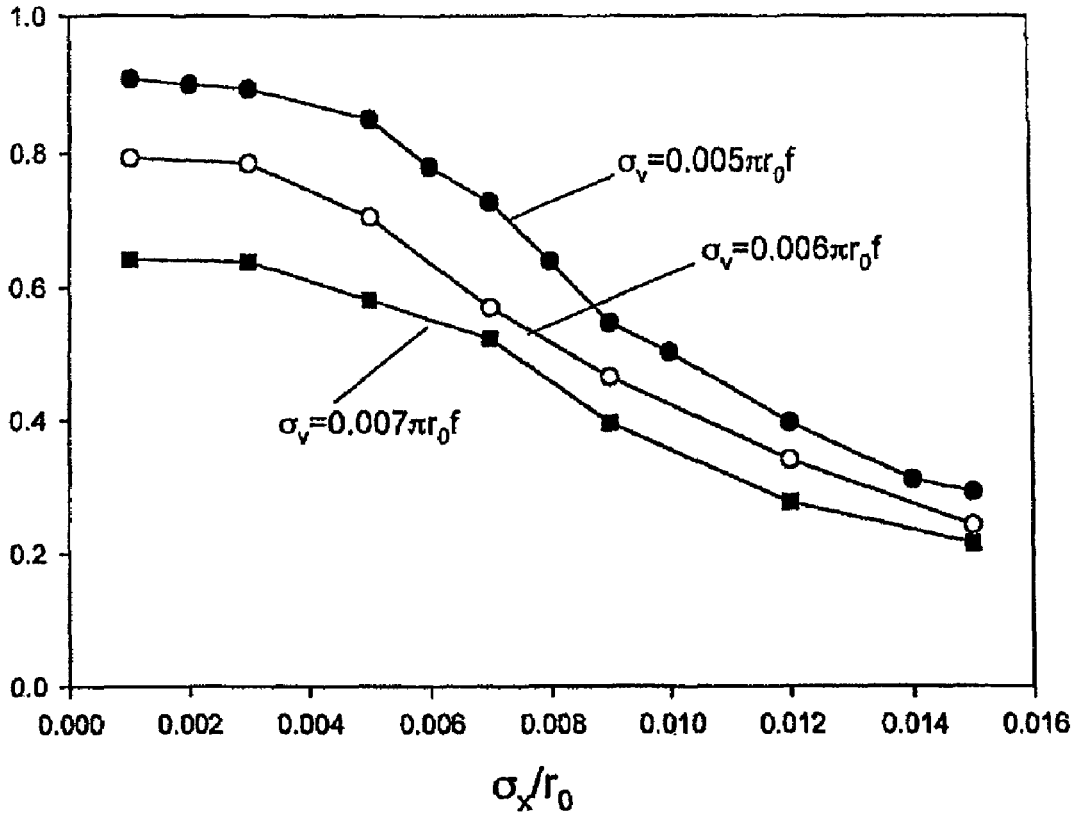
FIG. 4, in a graph, plots transmission vs. $\sigma_x/r_0$ for different values of transverse ion velocity dispersion $\sigma_v$ with mass 390, 300K, R=390, $\lambda$=0.1676, and 150 rf cycles in the field.
Figure 5:
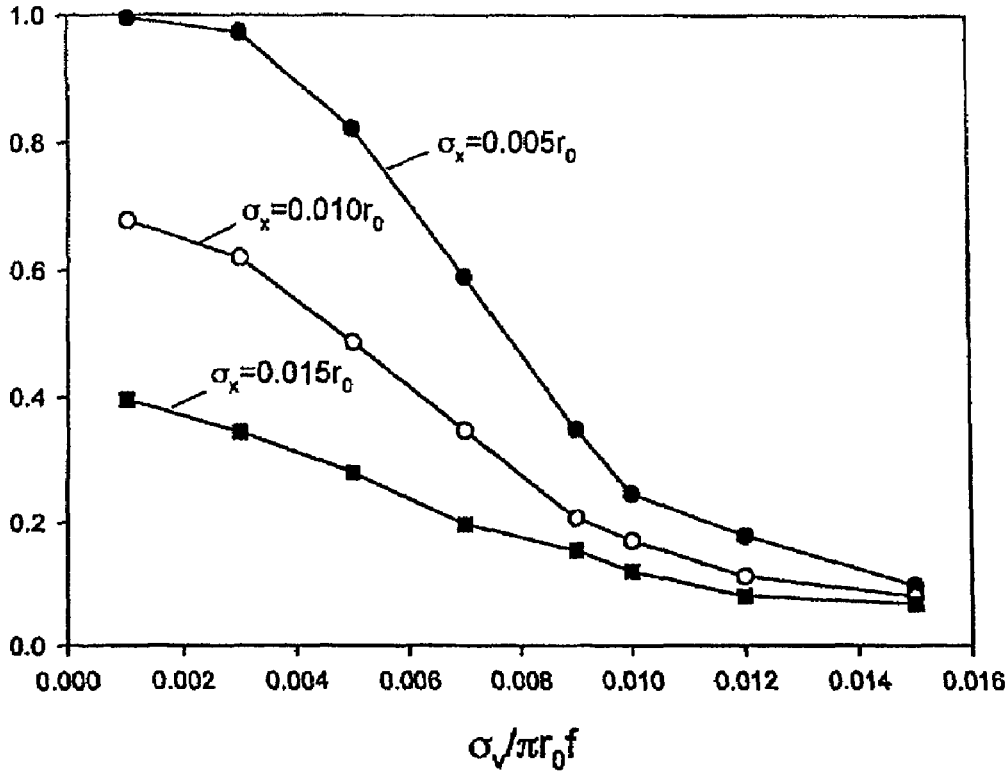
FIG. 5, in a graph, plots transmission vs. $\sigma_v/\pi r_0 f$ for three different spatial dispersions $\sigma_x$ for the conditions of FIG. 4.

The ion source model is characterized by the two parameters $\sigma_x$ and $\sigma_v$. The influence of the radial size of the ion beam on transmission for different values $\sigma_v$ is shown in FIG. 4. These data were calculated for a resolution R=390, λ=0.1676 (λ is defined above in equation 12), ion temperature T=300K, a separation time of n=150 rf cycles, a pure quadrupole field and no fringing fields. With ions concentrated near the axis with $\sigma_x<0.006r_0$ the transmission does not depend strongly on $\sigma_x$ for given values $\sigma_v$. For the same conditions the transmission for different values of $\sigma_x$ are shown in FIG. 5. High transmission near 100% at m/z=390 is possible because of the small ion beam emittance with $\sigma_x=0.005r_0$ and $\sigma_v=0.003\pi r_0 f$.

Peak Shape and Stability Region Calculations

Ion motion in quadrupole mass filters is described by the two Mathieu parameters a and q given by $$a = \frac{8eU}{mr_0^2\Omega^2} \text{ and } q = \frac{4eV_{rf}}{mr_0^2\Omega^2} \tag{7}$$

where e is the charge on an ion, U is the DC applied from an electrode to ground and $V_{rf}$ is the zero to peak RF voltage applied from an electrode to ground. For given applied voltages U and $V_{rf}$, ions of different mass to charge ratios lie on a scan line of slope $$a/q = 2\lambda = \frac{2U}{V_{rf}} \tag{12}$$

The presence of high order spatial harmonics in a quadrupole field leads to changes in the stability diagram as described in Ding, C.; Konenkov, N. V.; Douglas, D. J. "Quadrupole Mass Filters with Octopole Fields", *Rapid Commun. Mass Spectrom.* 2003, 17, 2495-2502 (hereinafter "reference [16]"). The detailed mathematical theory of the calculation of the stability boundaries for Mathieu and Hill equations is given in McLachlan, N. W. "Theory and Applications of Mathieu Functions" Oxford University Press, UK, 1947 (hereinafter "reference [17]") and for mass spectrometry applications is reviewed in reference [11]. However these methods cannot be used when the X and Y motions are coupled by higher spatial harmonics. Instead, the stability boundaries can be found by direct simulations of the ion motion. With higher multipoles in the potential, ion motion is determined by $$\frac{d^2x}{d\xi^2} + [a + 2q\cos 2(\xi - \xi_0)]x = -\frac{1}{2}[a + 2q\cos 2(\xi - \xi_0)]\sum_{N=3}^{10}\frac{A_N\frac{\partial\phi_N}{\partial x}}{A_2^{N/2}r_0^{N-2}} \tag{20}$$

$$\frac{d^2y}{d\xi^2} + [a + 2q\cos 2(\xi - \xi_0)]y = -\frac{1}{2}[a + 2q\cos 2(\xi - \xi_0)]\sum_{N=3}^{10}\frac{A_N\frac{\partial\phi_N}{\partial y}}{A_2^{N/2}r_0^{N-2}} \tag{21}$$

(see Douglas, D. J.; Konenkov, N. V. "Influence of the $6^{th}$ and $10^{th}$ Spatial Harmonics on the Peak Shape of a Quadrupole Mass Filter with Round Rods". *Rapid Commun. Mass Spectrom.* 2002, 16, 1425-1431 (hereinafter "reference [18]")).

Equations 20 and 21 were solved by the Runge-Kutta-Nystrom-Dormand-Prince (RK-N-DP) method, as described in Hairer, E.; Norsett, S. P.; Wanner, G. "Solving Ordinary Differential Equations". *Springer-Verlag*, Berlin, N.Y. 1987 (hereinafter "reference [19]") and multipoles up to N=10 were included. For the calculation of peak shapes, the values of a and q were systematically changed on a scan line with a fixed ratio λ. With the ion source model described above N ion trajectories were calculated for fixed rf phases $\xi_0=0, \pi/20, 2*\pi/20, 3*\pi/20, \ldots, 19*\pi/20$. If a given ion trajectory is not stable (x or $y \geqq r_0$) in the time interval $0<\xi<n\pi$, the program starts calculating a new trajectory. Here n is the number of rf cycles which the ions spend in the quadrupole field. From the number of transmitted ions, $N_t$, at a given point (a,q) the transmission is $T=N_t/N$. For the calculation of stability boundaries, a was fixed and q was systematically varied. The true boundaries correspond to the number of cycles that ions spend in the field, n, $n\rightarrow\infty$. For a practical calculation we choose n=150 and the 1% level of transmission. The value of a was fixed and q was scanned to produce a curve of transmission vs. q. For both peak shape and stability boundary calculations, the number of ion trajectories, N, was 6000 or more at each point of a transmission curve.

In all calculations the ions spend 150 rf cycles in the field. For rods with added hexapoles, the positive dc was applied to the X rods and the negative dc to the Y rods (a>0, λ>0). For rods with added octopoles, simulations were done for the positive dc applied to the X rods and the negative dc to the Y rods (a>0, λ>0). Simulations were then done with the polarity of the dc reversed (negative dc on the X rods and positive dc on the Y rods, a<0, λ<0).

EXAMPLES

$A_2$ Only and $A_2+A_3$ Only

Figure 6:
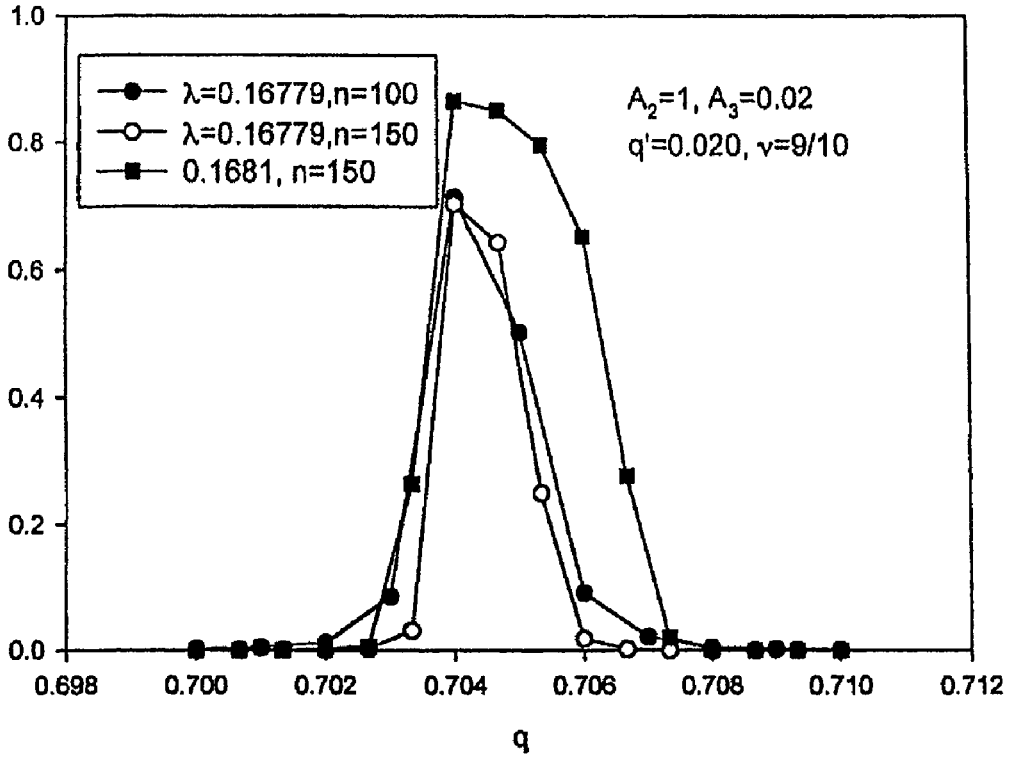
FIG. 6 shows peak shapes for a quadrupole mass filter with a 2% hexapole field and no higher fields operated at the lower tip of the uppermost stability island.
Figure 7:
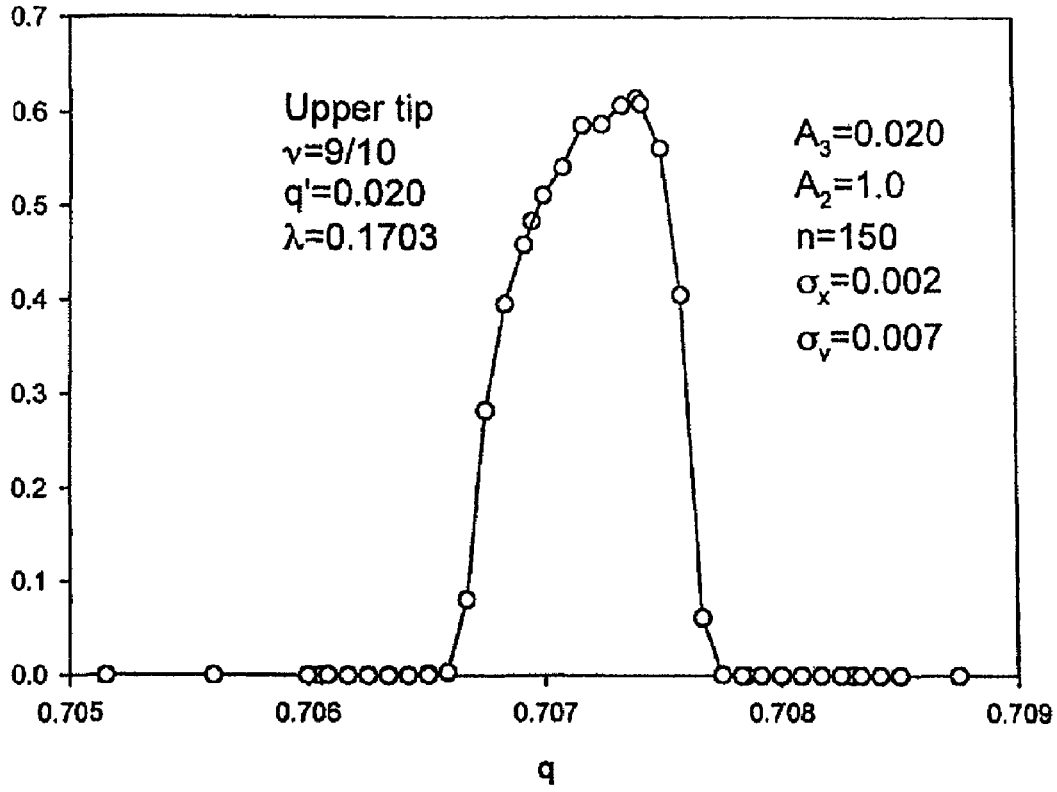
FIG. 7 shows mass analysis with a 2% hexapole at the upper tip of the uppermost stability island with higher resolution than that of FIG. 6.
Figure 8:
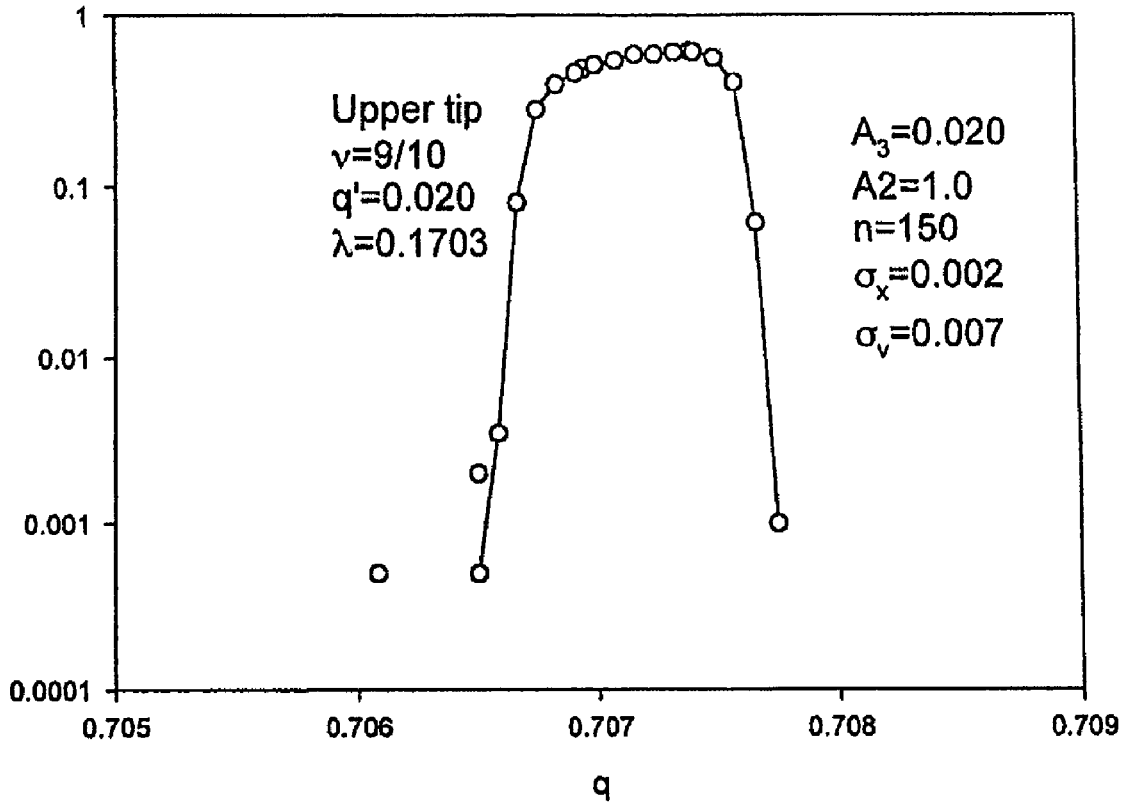
FIG. 8 illustrates the peak of FIG. 7 on a logarithmic scale.

FIG. 6 shows peak shapes for a quadrupole mass filter with 2% hexapole field and no higher fields ($A_2$=1.0, $A_3$=0.020), operated at the lower tip of the uppermost stability island. As described in U.S. Patent Publication No. 2005/0067564 (Douglas et al.), such a combination of fields can be provided by suitably shaped rods. The resolution is about $R_{1/2}$=400. The peak shape is smooth and symmetric. This illustrates that with an added hexapole, it is possible to mass analyze ions using the uppermost island of stability operated at the lower tip. FIG. 7 shows mass analysis for $A_2$=1.0 and $A_3$=0.020 at the upper tip of the uppermost stability island with higher resolution, $R_{1/2}$=843, demonstrating that with an added hexapole field, mass analysis at the upper tip of the uppermost island of stability is possible. FIG. 8 shows the same peak but on a logarithmic scale. With the logarithmic scale it can be seen that there is minimal tailing on either side of the peak.

Figure 9:
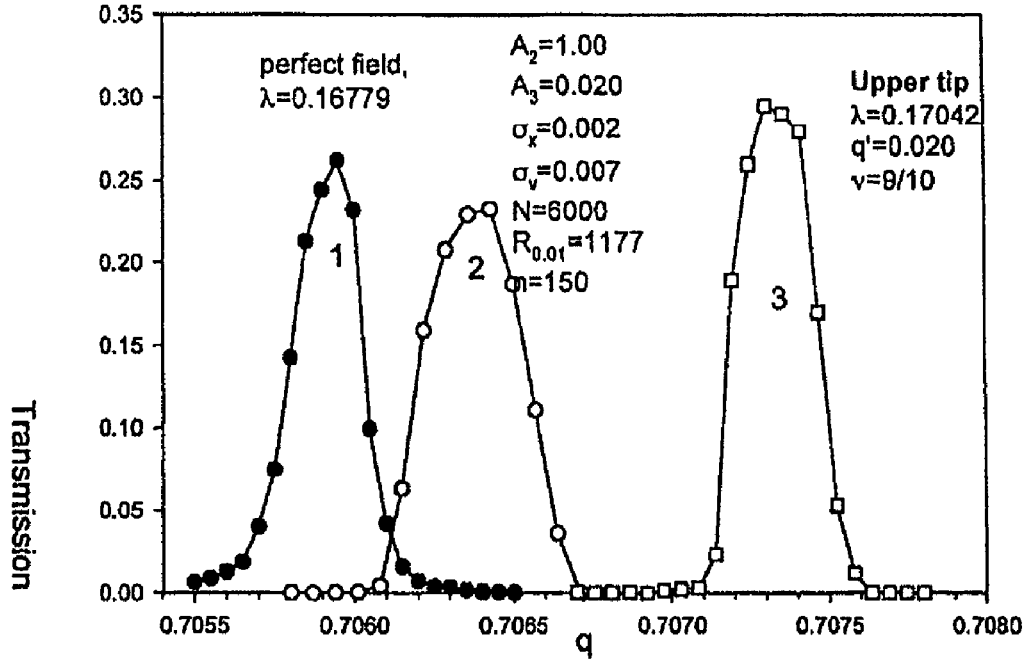
FIG. 9 compares peak shapes for an ideal quadrupole field operated in conventional mass analysis mode, with a 2% added hexapole operated in conventional mass analysis mode, and a quadrupole field with a 2% added hexapole operated at the upper tip of the uppermost stability island.

FIG. 9 compares peak shapes for an ideal quadrupole field with $R_{1/2}$=2882 (peak 1) operated in conventional mass analysis mode, a quadrupole with $A_2$=1.0 and $A_3$=0.020 operated in conventional mass analysis mode at $R_{1/2}$=1976 (peak 2) and a quadrupole with $A_2$=1.0 and $A_3$=0.02 operated at the upper tip of the upper stability island with $R_{1/2}$=2389. In all three cases there is good peak shape and resolution. Peak 3, formed with operation in the island, has slightly higher transmission and resolution than that of an ideal quadrupole (peak 1). It also has somewhat sharper sides with less peak tailing and so the performance exceeds that of an ideal quadrupole field.

Figure 10:
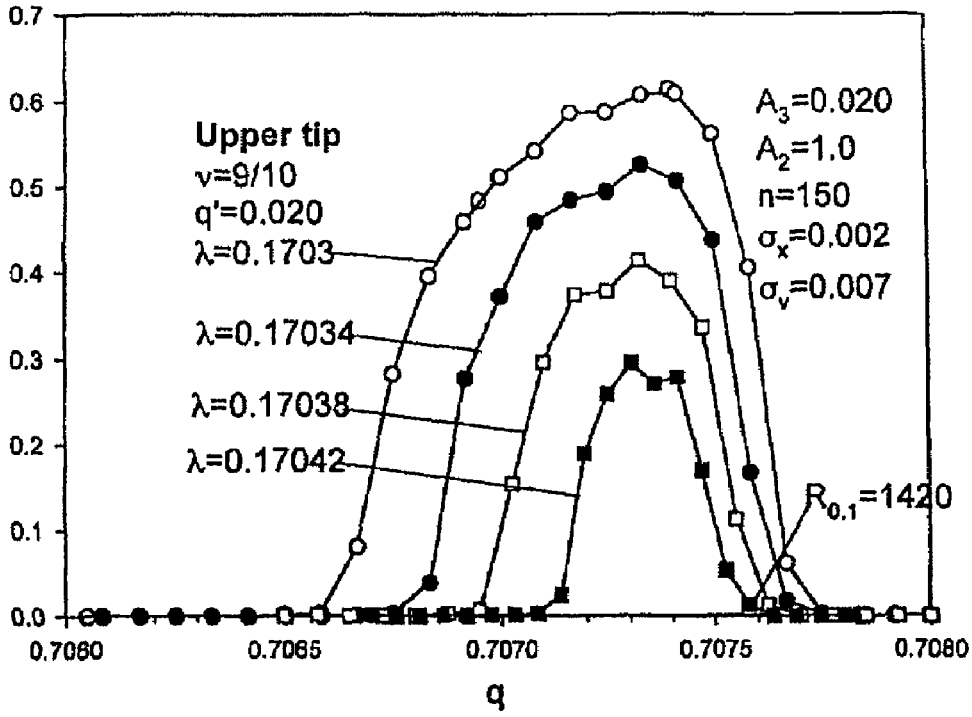
FIG. 10 shows peak shapes at different resolutions for a quadrupole with a 2% added hexapole operated at the upper tip of the uppermost stability island.
Figure 11:
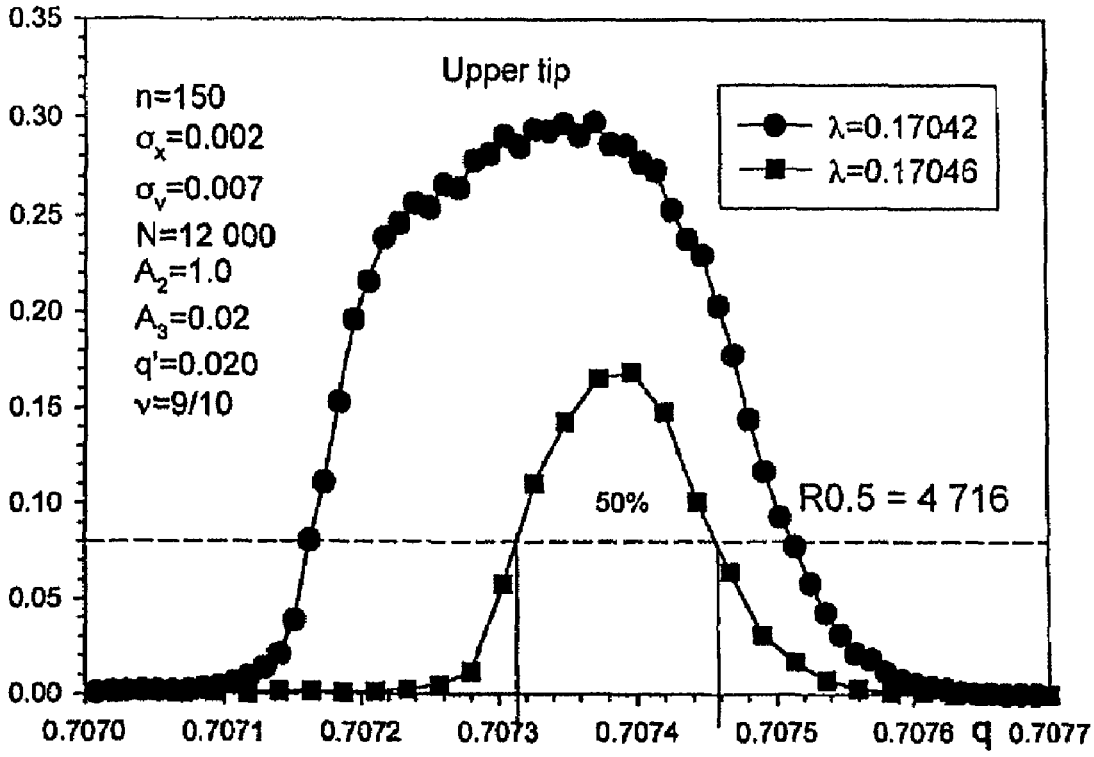
FIG. 11 illustrates a peak at high resolution obtained using a quadrupole with a 2% added hexapole harmonic with operation at the upper tip of the uppermost stability island.

FIG. 10 shows peak shapes at resolutions $R_{1/2}$ from 900-2300 for a quadrupole with 2% hexapole ($A_2$ and $A_3$ only) operated at the upper tip. Over this resolution range there is minimal structure on the peaks and the transmission drops monotonically with increasing resolution. FIG. 11 shows that a resolution of 4716 can be obtained with a quadrupole with 2% hexapole field ($A_2$=1.0 $A_3$=0.020, no other harmonics) with operation at the upper tip. The transmission at the peak remains greater than 10%. Even at this high resolution, there is less peak tailing than that of an ideal quadrupole field (c.f. FIG. 9, peak 1).

Round Rods, $R_x>R_y$, $A_1=0$ $A_4\approx 0$.

The Dipole Term $A_1$

When a hexapole is added to a linear quadrupole field by rotating the Y rods towards the X rod, a significant dipole term, $A_1$ is added. The dipole term in the potential has the form $$A_1\left(\frac{x}{r_0}\right)\varphi(t).$$

This term arises because the field is no longer symmetric about the y axis 119. The dipole term can be removed by applying different voltages to the two x rods, either with a larger voltage applied to the x rod in the positive x direction or a smaller voltage applied to the x rod in the negative x direction, or a combination of these changes (see U.S. Patent Publication No. 2005/0067564 (Douglas et al.).

The dipole term arises because the centre of the field is no longer at the point x=0, y=0 of FIG. 3. The potential is approximately given by $$V(x, y) = \left[A_1\left(\frac{x}{r_0}\right) + A_2\left(\frac{x^2 - y^2}{r_0^2}\right) + A_3\left(\frac{x^3 - 3xy^2}{r_0^3}\right)\right]\varphi(t) \tag{22}$$

Let $\hat{x} = x + x_0$ or $x = \hat{x} - x_0$. Then $$\frac{V(\hat{x}, y)}{\varphi(t)} = A_1\left(\frac{(\hat{x} - x_0)}{r_0}\right) + A_2\left(\frac{(\hat{x} - x_0)^2 - y^2}{r_0^2}\right) + A_3\left(\frac{(\hat{x} - x_0)^3 - 3(\hat{x} - x_0)y^2}{r_0^3}\right) \tag{23}$$

Expanding the terms gives $$\frac{V(\hat{x}, y)}{\varphi(t)} = A_3\left(\frac{\hat{x}^3}{r_0^3}\right) + \left(\frac{A_2}{r_0^2} - \frac{3x_0A_3}{r_0^3}\right)\hat{x}^2 + \left(\frac{A_1}{r_0} - \frac{2x_0A_2}{r_0^2} + \frac{3x_0^2A_3}{r_0^3} - \frac{3y^2}{r_0^3}\right)\hat{x} + \left(\frac{-A_1x_0}{r_0} + \frac{A_2x_0^2}{r_0^2} - \frac{A_3x_0^2}{r_0^3}\right) \tag{24}$$

Consider the coefficient of $\hat{x}$ when y=0. This will be zero if $$\frac{A_1}{r_0} - \frac{2x_0A_2}{r_0^2} + \frac{3x_0^2A_3}{r_0^3} = 0 \tag{25}$$

The last term is much smaller than the first two, so to a good approximation the coefficient of the dipole is zero if $$\frac{A_1}{r_0} - \frac{2x_0A_2}{r_0^2} = 0 \tag{26}$$

or $$x_0 = \frac{A_1r_0}{2A_2} \tag{27}$$

More exactly eq 25 is a quadratic in $x_0$ which can be solved to give $$x_0 = \frac{\frac{2A_2}{r_0^2} \pm \sqrt{\frac{4A_2^2}{r_0^4} - 4\frac{A_1}{r_0}\frac{3A_3}{r_0^3}}}{2\frac{3A_3}{r_0^3}} \tag{28}$$

It is the solution with the minus sign that is realistic. Table 1 below shows the approximate and exact values of $x_0$ calculated from eq 27 and eq 28 respectively for three rotation angles which give nominal hexapole fields of 4, 8, and 12%.

TABLE 1

Comparison of values of $x_0$ from the approximate eq 27 and the exact eq 28

| θ (degrees) | $A_1$ | $A_2$ | $A_3$ | $x_0$ from eq 27 | $x_0$ from eq 28 |
|---|---|---|---|---|---|
| 2.56 | −0.0314 | 1.001 | 0.0396 | $-0.0157r_0$ | $-0.0156r_0$ |
| 5.13 | −0.0629 | 0.9975 | 0.0789 | $-0.0315r_0$ | $-0.0313r_0$ |
| 7.69 | −0.0942 | 0.9906 | 0.1172 | $-0.0471r_0$ | $-0.0467r_0$ |

Because $A_1<0$, $x_0<0$. e.g. $\hat{x}=x-0.0315r_0$. When $\hat{x}=0$, $x=+0.0315r_0$. When x=0, $\hat{x}=-0.0315r_0$. The centre of the field is shifted in the direction of the positive x axis. This calculation is still approximate because it does not include the higher multipoles. However it is likely adequate for practical purposes. Thus, the effects of the dipole can be minimized by injecting the ions centered at the point where $\hat{x}=0$.

When a hexapole is added to a linear quadrupole field by rotating two Y rods toward an X rod, the next highest term in the multipole expansion $A_1$, $A_2$ and $A_3$ is the octopole term (see U.S. Patent Publication No. 2005/0067564 (Douglas et al)). This term can be minimized by constructing the rod sets with different diameters for the X and Y rods. For a given rotation angle, the diameter of the x rods can be increased to make $A_4\approx0$. These diameters are shown in Table 2. With conventional mass analysis with applied RF and DC, when $A_4$ is minimized the peak shape improves. For the data in Table 2, $R_y=1.1487r_0$.

TABLE 2

Values of $R_x/r_0$ that give $A_4 = 0$.

| nominal $A_3$ | angle (degrees) | $A_3$ | $A_4$ | new $R_x/r_0$ to make $A_4 = 0$ | $A_4$ with new $R_x$ |
|---|---|---|---|---|---|
| 2% | 1.28 | 0.0198299 | 0.0005060 | 1.1540 | $5.62 \times 10^{-5}$ |
| 4% | 2.56 | 0.0396057 | 0.0020210 | 1.1730 | $1.38 \times 10^{-5}$ |
| 6% | 3.85 | 0.0594268 | 0.0045593 | 1.2050 | $5.05 \times 10^{-6}$ |
| 8% | 5.13 | 0.0789318 | 0.0080662 | 1.2500 | $2.51 \times 10^{-5}$ |
| 10% | 6.50 | 0.0099569 | 0.0128860 | 1.3185 | $3.54 \times 10^{-6}$ |
| 12% | 7.69 | 0.1172451 | 0.0179422 | 1.4000 | $1.75 \times 10^{-4}$ |

Figure 12:
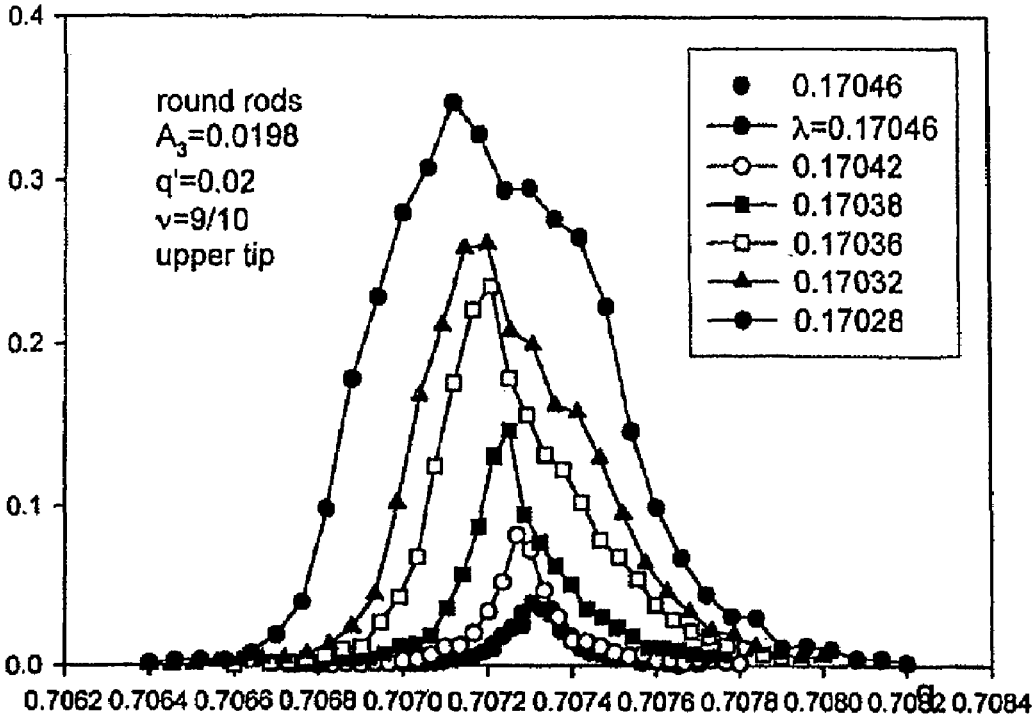
FIG. 12 shows peak shapes obtained with a round rod set having a substantially quadrupole field with a 2% added hexapole, $A_1$=0, and a negligible octopole harmonic, operated at the upper tip of the uppermost island of stability.
Figure 13:
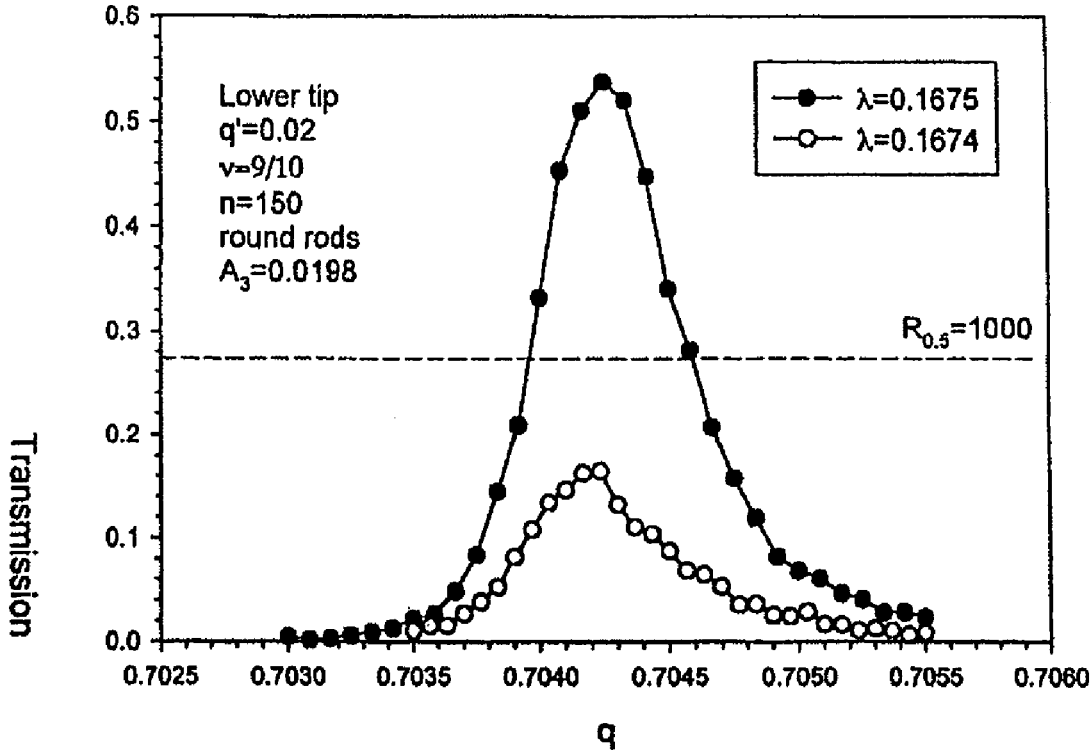
FIG. 13 shows mass analysis with a round rod set with a 2% added hexapole at the lower tip of the uppermost island of stability at different resolutions.

FIG. 12 shows peak shapes obtained with a round rod set ($A_4\approx0, A_1=0$) with 2% hexapole for resolution $R_{1/2}$ from 1270 to 5081 with operation at the upper tip of the uppermost island of stability. A resolution of more than 5000 is possible. The peaks are relatively free of structure. FIG. 13 shows mass analysis with a round rod set with 2% hexapole at the lower tip of the uppermost island of stability, with resolutions of 1000 and 1200. The peak with $R_{1/2}=1200$ has transmission of ca. 15%. With operation at the upper tip and similar resolution the transmission is ca. 35%. Thus operation at the upper tip is preferred for this rod set.

Figure 14:
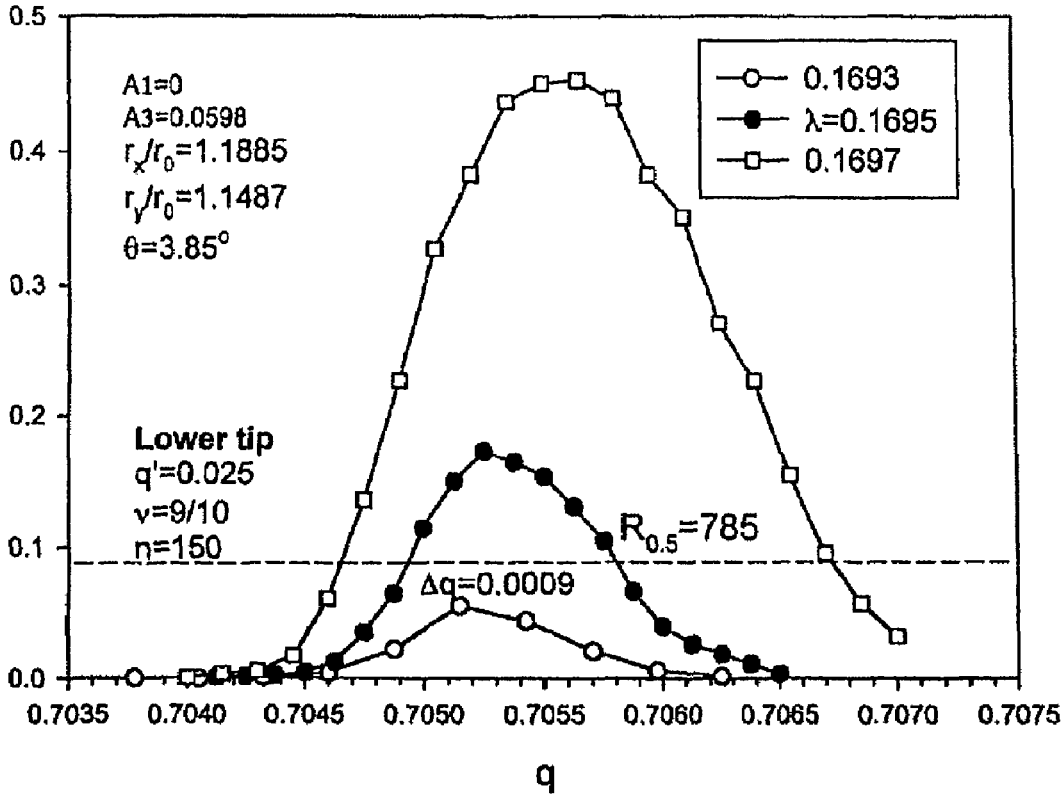
FIG. 14 illustrates peaks with operation at the lower tip of the uppermost stability island using round rod sets where the hexapole component is increased to 6%, $A_1$=0 and there is a negligible octopole component.

FIG. 14 shows peaks with operation at the lower tip of the stability island with round rod sets where $A_3$ is increased to $A_3=6\%$ and with $R_{1/2}$ from 460 to 980 ($A_4\approx0$, $A_1=0$). Over this range the peaks remain smooth. This contrasts with operation at the tip of the conventional stability diagram where structure is formed on the peaks at intermediate resolution.

Figure 15:
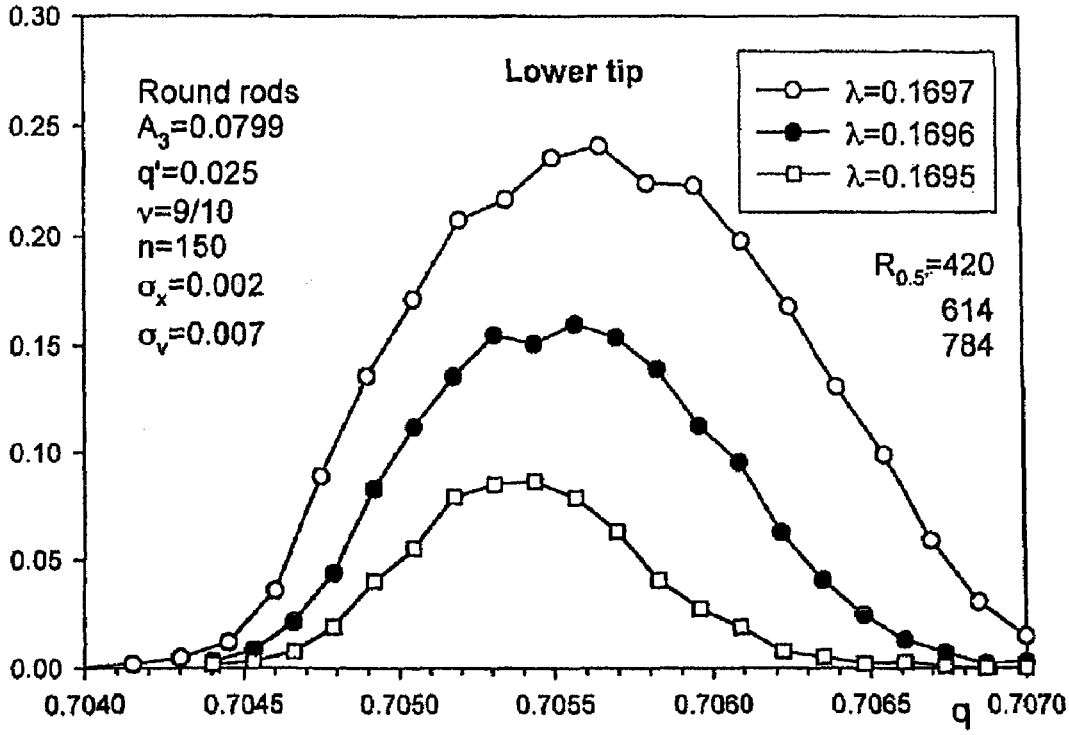
FIG. 15 shows peak shapes with round rods where the hexapole component is further increased to 8%, $A_1$=0, $A_4 \approx 0$ and with operation at the lower tip of the uppermost stability island, at different resolutions.
Figure 16A:
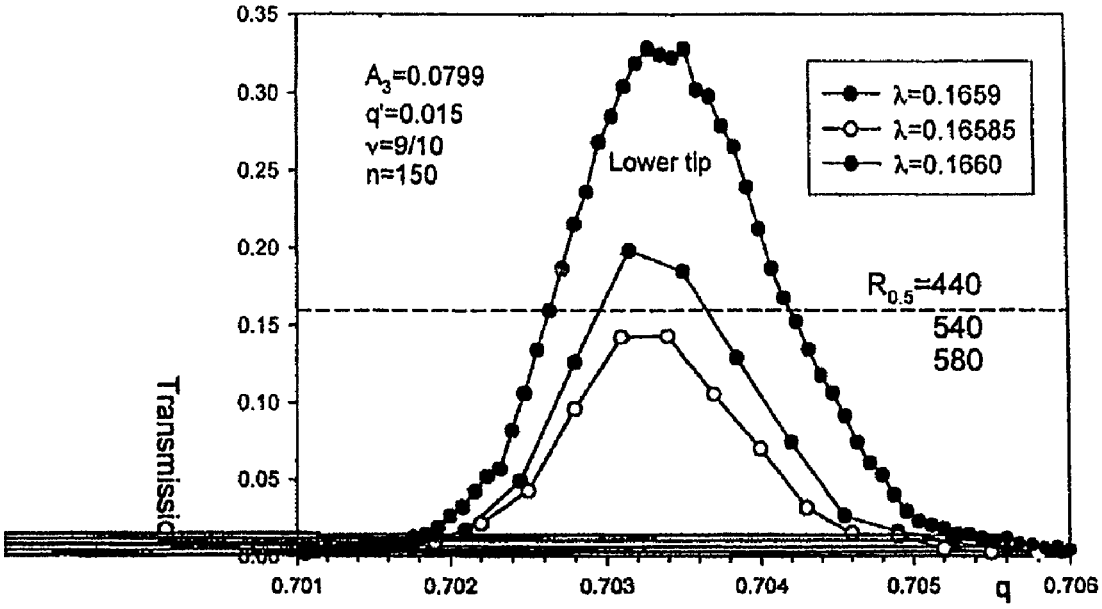
FIGS. 16*a-f* illustrate the effect of changing q' for a rod set with round rods and 8% hexapole ($A_1$=0, $A_4 \approx 0$).
Figure 16B:
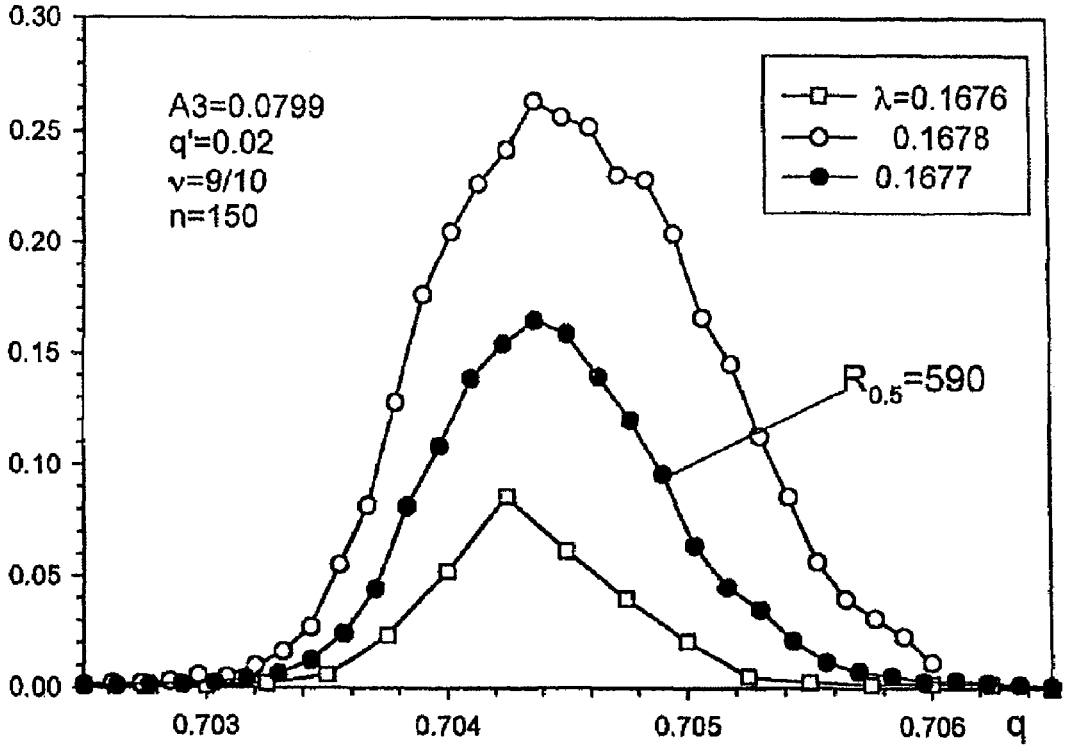
Figure 16C:
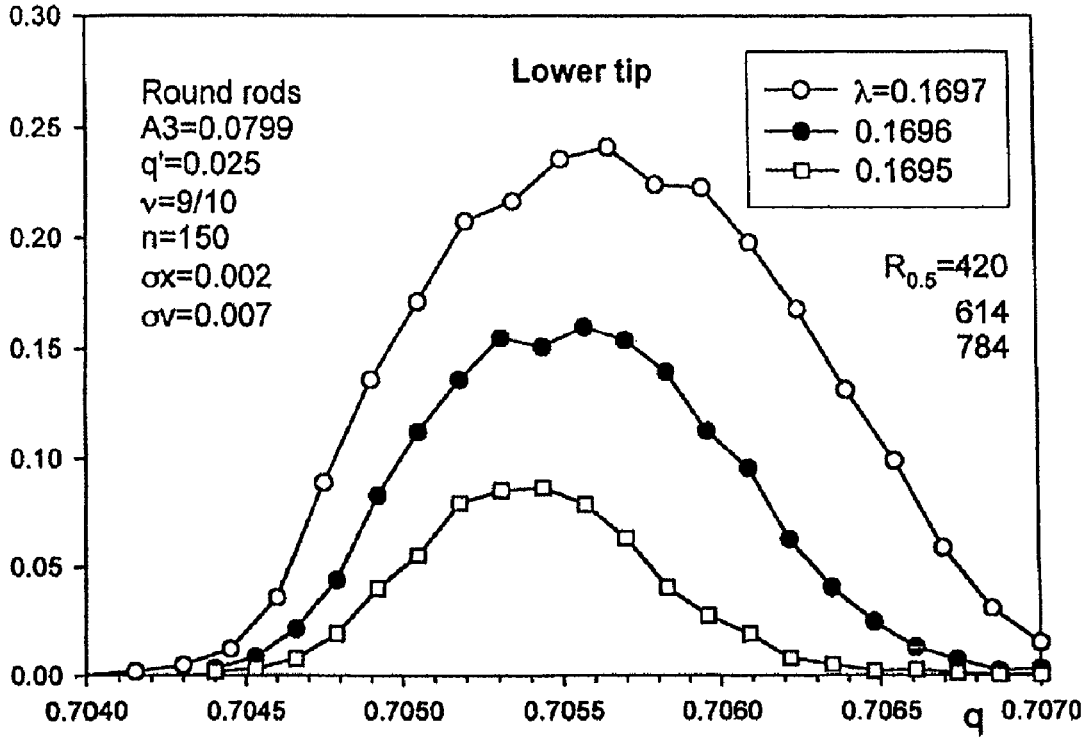
Figure 16D:
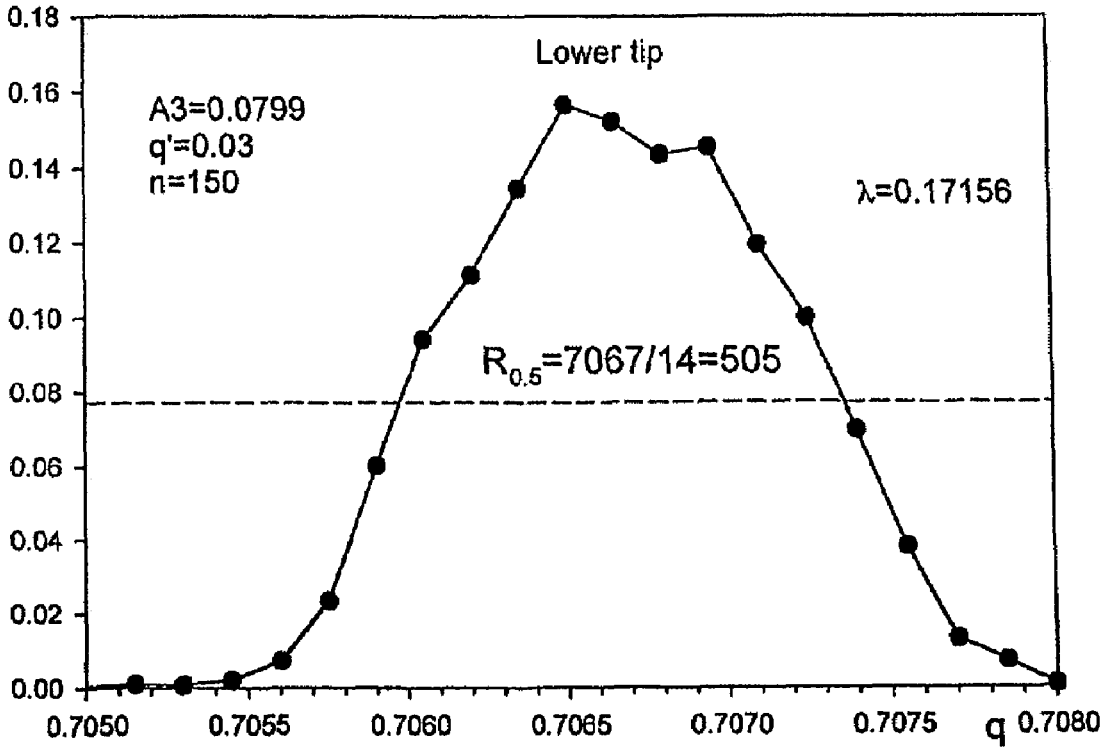
Figure 16E:
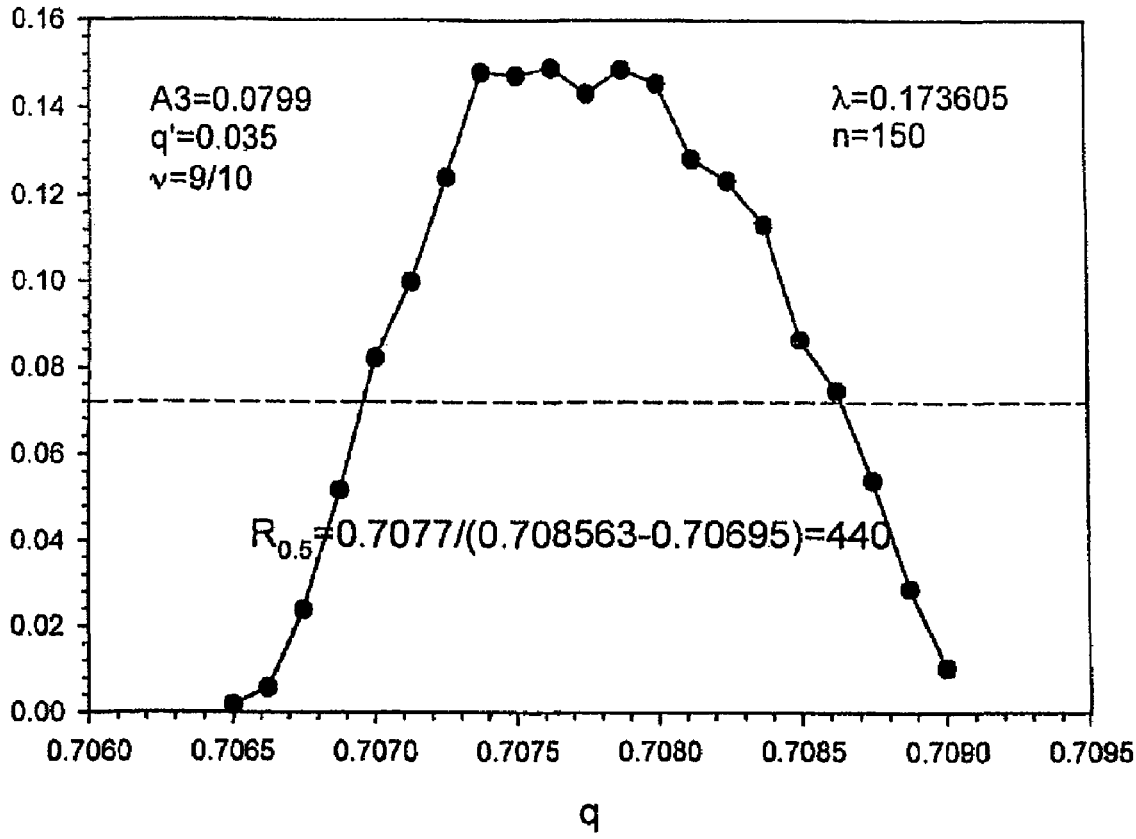
Figure 16F:
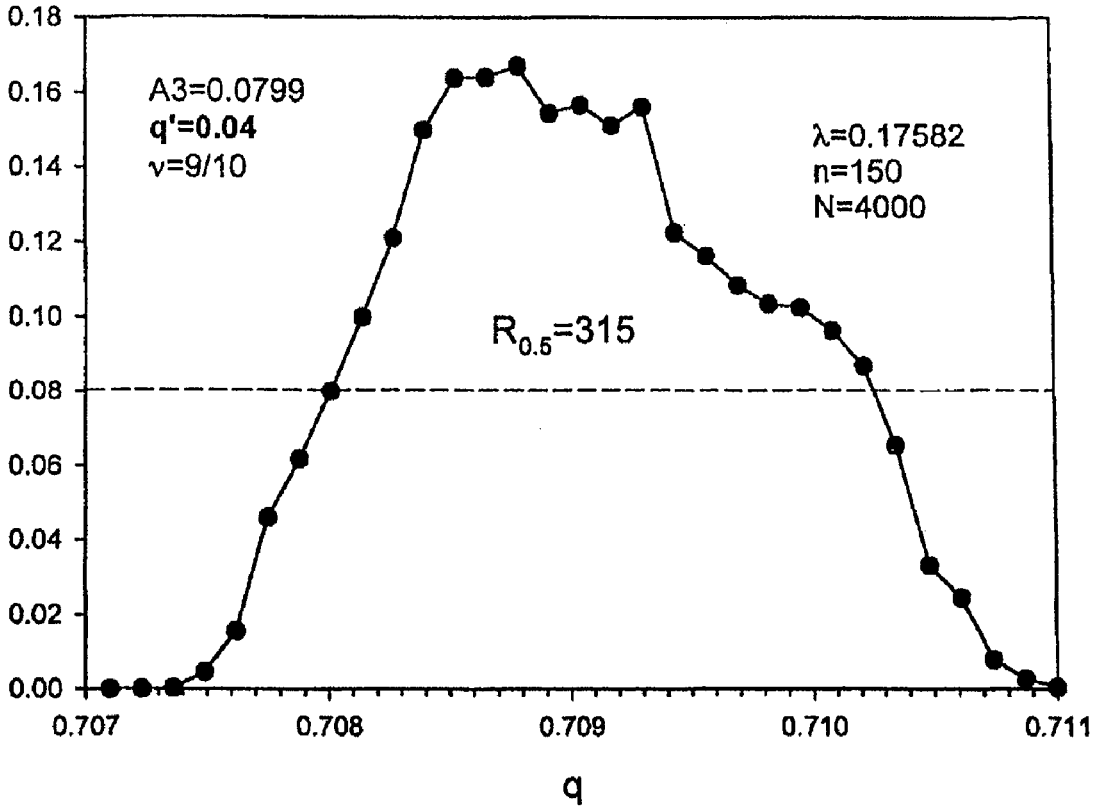

FIG. 15 shows peak shapes with round rods where the hexapole component is further increased to 8%, $A_1=0$, $A_4\approx0$ and with operation at the lower tip, and $R_{1/2}$ of 420, 614 and 784. Despite the relatively high hexapole component, good peak shape and resolution are possible over this range.

The resolution is controlled by the scan parameter λ, but also by the value of q'. For a given transmission level, there is an optimum q'. Six figures show the effects of changing q' for a rod set with round rods and 8% hexapole ($A_1=0$, $A_4\approx0$). These are summarized in Table 3.

TABLE 3

| Figure | q' | $R_{1/2}$ at 15% transmission |
|---|---|---|
| 16a | 0.015 | 440 |
| 16b | 0.020 | 590 |
| 16c | 0.025 | 614 |
| 16d | 0.030 | 505 |
| 16e | 0.035 | 440 |
| 16f | 0.040 | 315 |

FIGS. **16*a*-16*f*** and Table 3 show that the optimum value of q' for these operating conditions is q'=0.025, because this produces the highest resolution with 15% transmission.

Round Rods with $R_x=R_y=1.1487r_0$, $A_4\neq0$

Figure 17:
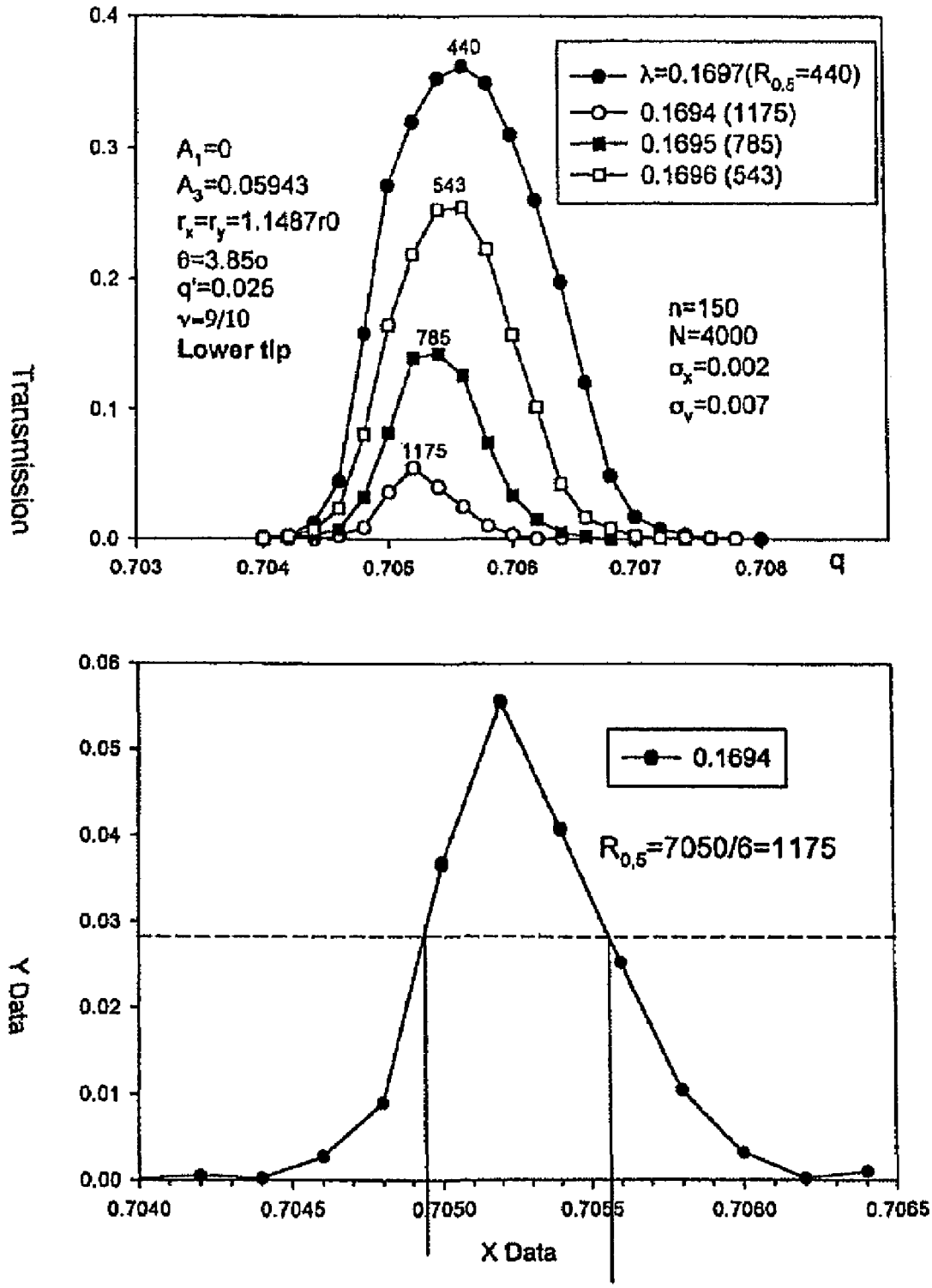
FIG. 17 illustrates peaks produced with a rod set with a 6% hexapole field and X rods and Y rods of equal diameter, operated at the lower tip of the uppermost stability island.

The above calculations for round rod sets are for the electrode geometries that make $A_4\approx0$. i.e. larger diameter X rods than Y rods. When equal diameter round rods are used, mass analysis at the lower tip of the upper stability island produces good peak shape and resolution. FIG. 17 shows peaks produced with a rod set with 6% hexapole field and $R_x/r_0=R_y/r_0=1.1487$, operated at the lower tip. Because equal diameter rods are used there is a significant octopole amplitude $A_4=4.56\times10^{-3}$. Peaks with resolutions $R_{1/2}$ from 440 to 1175 are shown. The peaks are free of structure. Over this same range, with conventional mass analysis at the upper tip of the stability region, structure is formed on the peak and the transmission is low. Thus mass analysis at the lower tip of the island is possible even with rod sets constructed with equal diameter rods. Because it is less expensive to construct rod sets with equal diameter rods than with different diameters, this allows a method of adding a hexapole field with rod sets that are more easily constructed.

Figure 18:
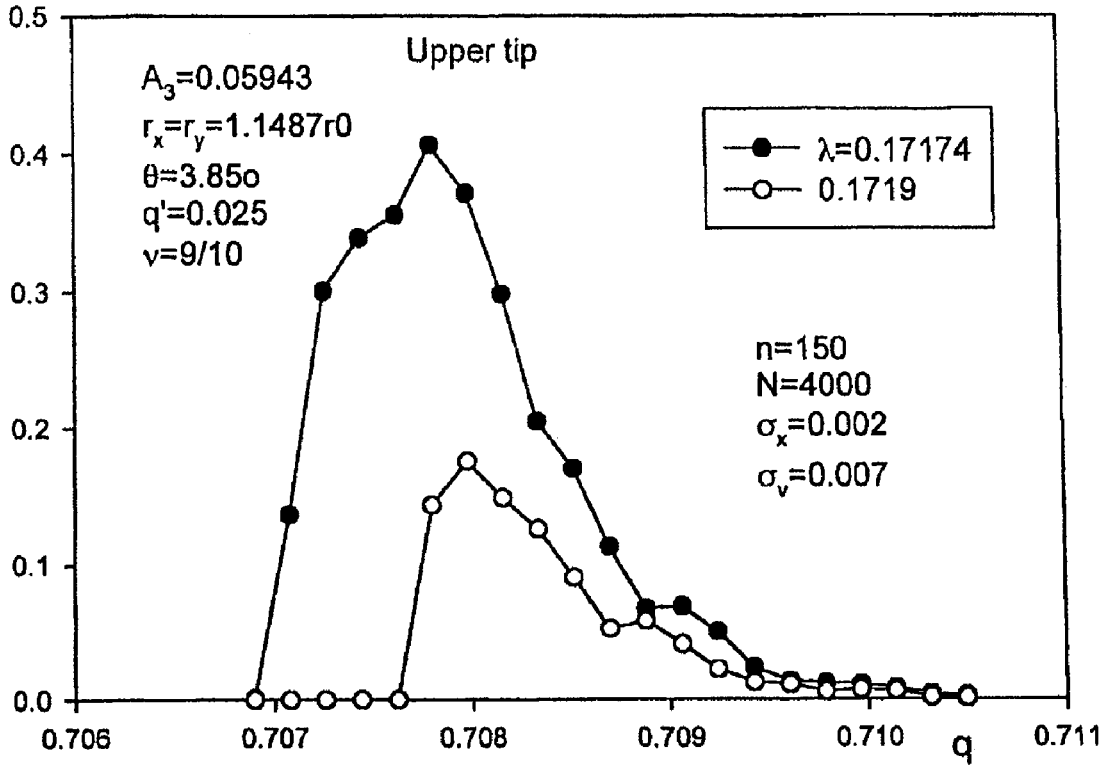
FIG. 18 shows mass analysis with the rod set of FIG. 17, but with operation at the upper tip of the uppermost stability island.

FIG. 18 shows mass analysis with the same rod set but with operation at the upper tip. The peaks are sharp on the low q side but have undesirable tails on the high q side. Thus, for this rod set, operation at the lower tip is preferred.

Figure 19A:
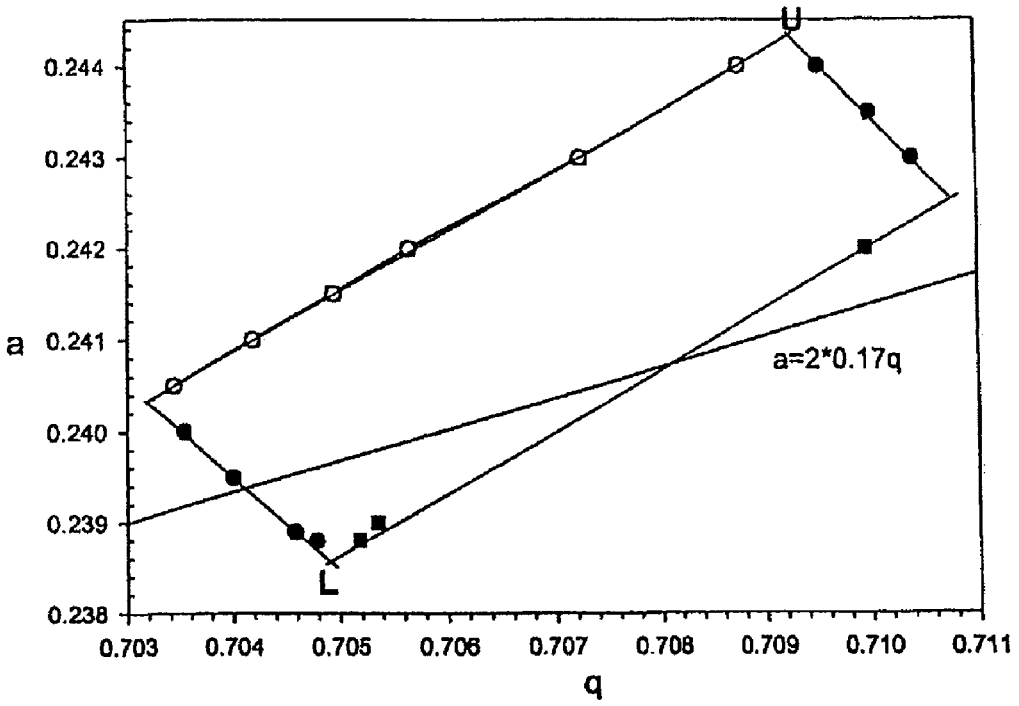
FIG. 19*a* shows the uppermost stability island calculated for the round rod set of FIGS. 17 and 18.
Figure 19B:
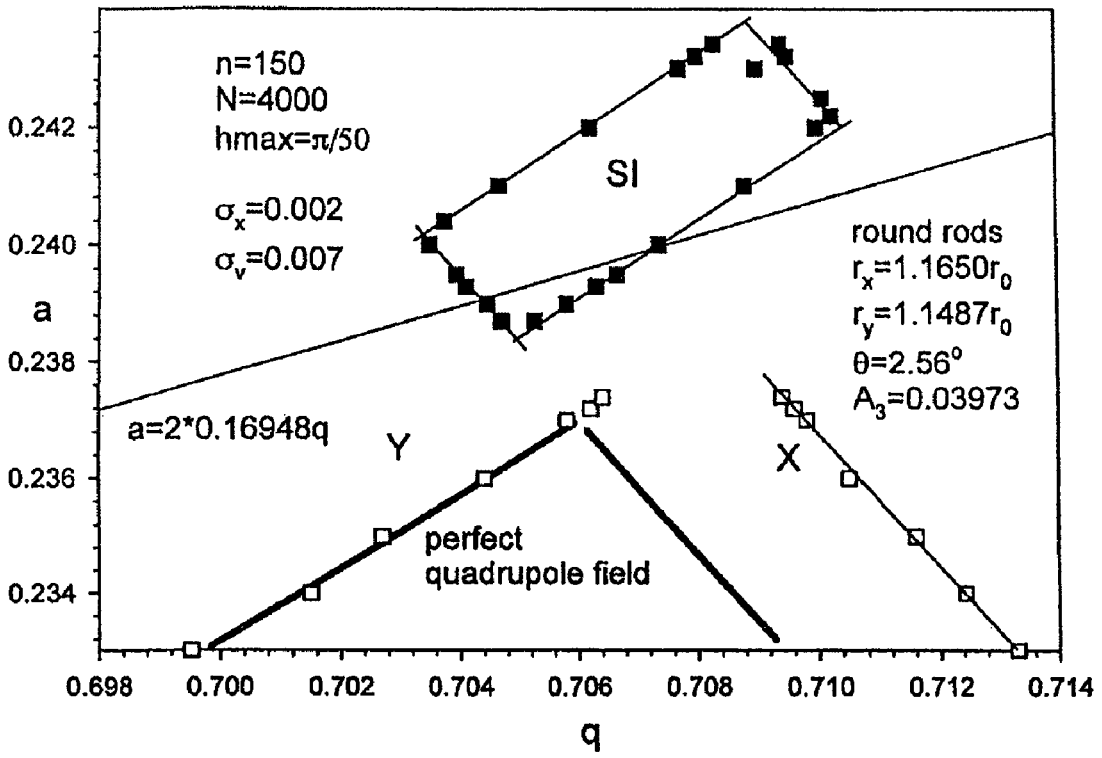
FIG. 19*b* shows the stability boundaries and island of stability for a quadrupole constructed with round rods with X rods of different diameter than the Y rods to make the octopole component substantially equal to zero.

FIG. 19*a* shows the uppermost island of stability calculated for this round rod set. The upper and lower tips are labeled U and L. All the multipoles up to N=10, in a co-ordinate system that makes $A_1=0$, are included in the calculation. This figure also shows that a scan line with $\lambda=0.17$ crosses this region. FIG. 19*b* shows the stability boundaries and island of stability for a quadrupole constructed with round rods, $A_3=4\%$, $R_x=1.165r_0$ and $R_y=1.1487r_0$ so $A_4\approx0$. The calculation is for the co-ordinate system that makes $A_1=0$. The boundaries of the stability diagram for a pure quadrupole field are shown. The X boundary for the rod set with 4% hexapole is also shown. It is shifted out relative to the boundary of a pure quadrupole field. The stability island for this rod set with $q'=0.025$ and $v=9/10$ is also shown. A scan line with $\lambda=0.16948$ crosses the lower tip of the stability island.

Added Octopole Field

A positive octopole field ($A_4>0$) can be added to a linear quadrupole by making the Y rods greater in diameter than the X rods. If positive dc is applied to the X or smaller rods a>0. If negative dc is applied to the X or smaller rods, then a<0. With a>0, when quadrupole excitation is applied to make islands in the first stability region, an island can be formed at the upper tip of the stability region near a=+0.23. This island has two tips, one with a larger value of the |a| and another with a lesser |a|. Similarly, when a<0 an island is formed at the tip of the stability diagram near a=−0.23. This island has two tips, one with a larger value of the |a| and another with a lesser |a|.

A rod set with $A_4=0.026$ was modeled. This rod set has round rods with $R_x=r_0$, $R_y/R_x=1.304$ and is in a case with radius $4r_0$, giving the multipoles in Table 4.

TABLE 4

| $A_0$ | $A_2$ | $A_4$ | $A_6$ | $A_8$ | $A_{10}$ |
|---|---|---|---|---|---|
| −0.02664665 | 1.00149121 | 0.02592904 | 0.00119149 | 0.00095967 | −0.00233790 |

Figure 20:
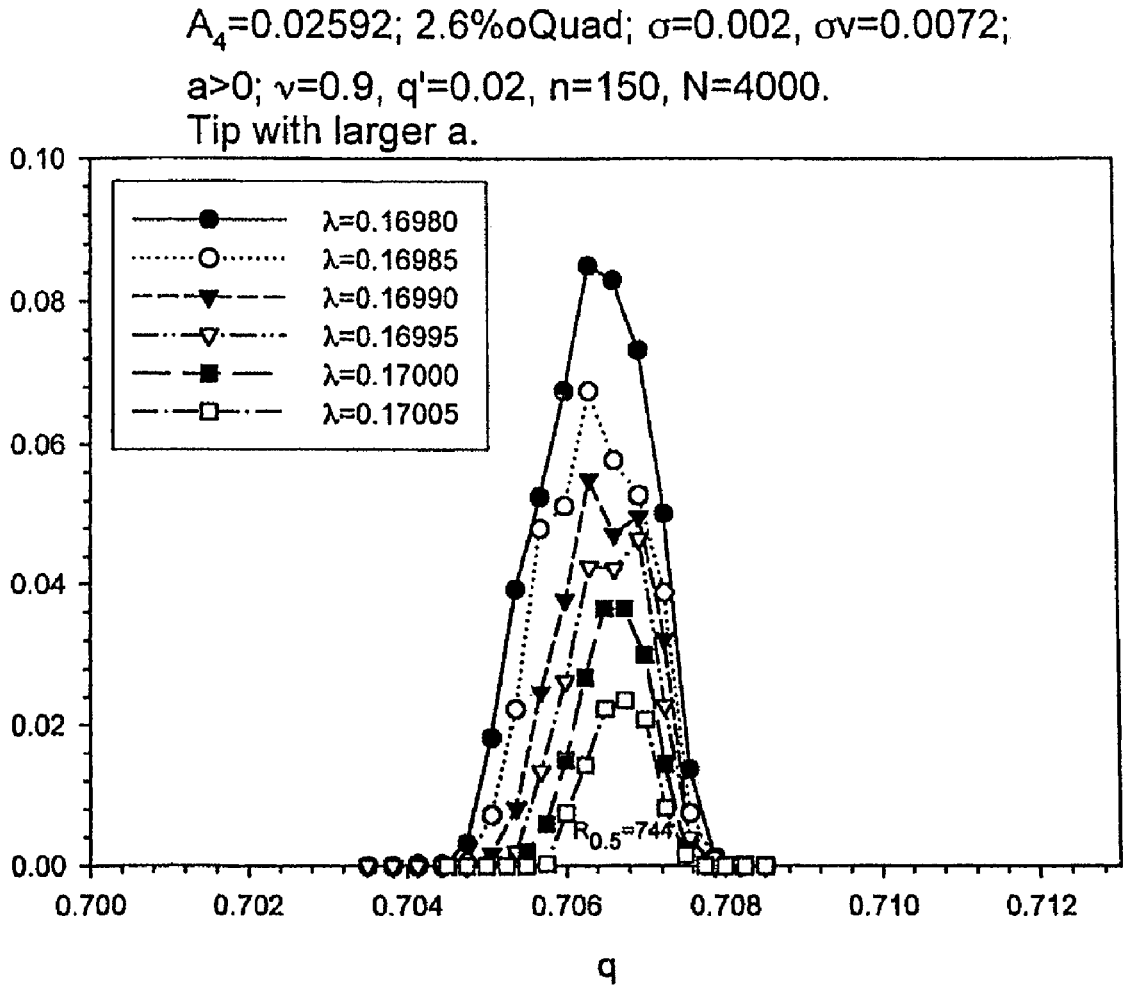
FIG. 20 shows peak shapes calculated for a rod set with a nominal 2.6% octopole field constructed with round rods having $R_y/R_x$=1.300 operated at the upper tip of the uppermost stability island.

FIG. 20 shows peak shapes calculated for a rod set with nominal 2.6% octopole field constructed with round rods that have $R_y/R_x=1.300$ (reference [16]). The method of adding an octopole field is described in Sudakov, M.; Douglas, D. J. "Linear Quadrupoles with Added Octopole Fields," *Rapid Commun. Mass Spectrom.* 2003, 17, 2290-2294 (hereinafter "reference [20]"). All the even multipoles up to N=10 were included in the calculation, as shown in Table 4. The odd multipole amplitudes are zero. The calculation is for positive ions with positive dc applied to the smaller rods (X rods)(a>0, λ>0). The highest resolution shown is about $R_{1/2}=744$.The figure illustrates that mass analysis in the uppermost island of stability with operation at the upper tip—larger |a|—is possible when there is an added octopole field.

Figure 21:
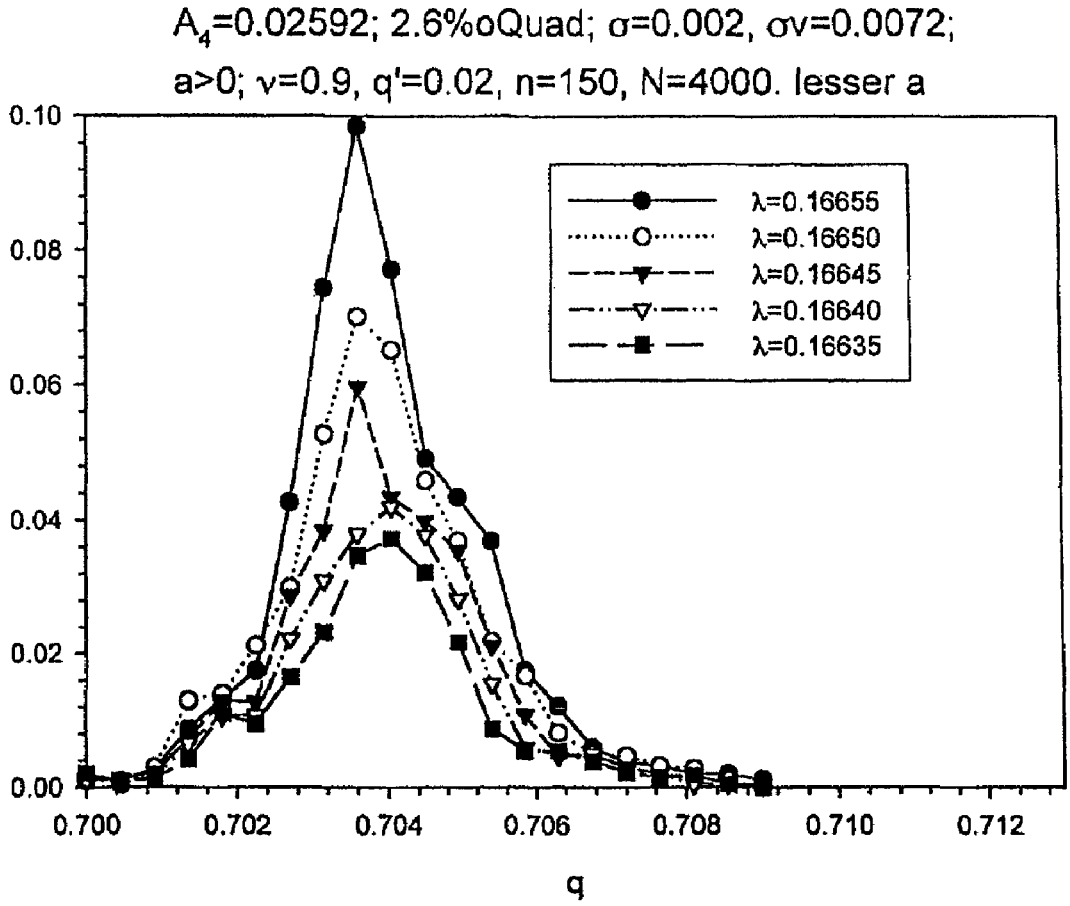
FIG. 21 shows peak shapes calculated for the same rod set but with operation at the lower tip of the uppermost stability island.

FIG. 21 shows peak shapes calculated for the same rod set but with operation at the lower tip—lesser |a| of the uppermost stability island (a>0, λ>0). The peak shape is poor and the resolution is low. There are undesirable tails on both the high and low mass sides of the peak. When the value of λ is lowered to 0.1664 in an attempt to produce higher resolution, the resolution decreases. This is accompanied by a decrease in transmission. Comparison of FIGS. 20 and 21 shows that with an octopole field added by constructing a quadrupole with round rods that have one rod diameter greater than the other, and with a>0, operation at the upper tip is preferred. This contrasts with round rod sets that have an added hexapole constructed as described in U.S. Patent Publication No. 2005/0067564 (Douglas et al.), where operation at the lower tip gives the best performance.

With a quadrupole with an added octopole field constructed with Y rods greater in diameter than the X rods, when the polarity of the dc is reversed so that the negative dc is applied to the X rods and the positive dc is applied to the Y rods, the performance in conventional mass analysis is greatly degraded. The transmission drops and the resolution is poor as described in U.S. Pat. No. 6,897,438, May 24, 2005 and as described in reference [16]. This has been ascribed to changes in the stability diagram. The stability boundaries move out, become diffuse and are no longer even approximately straight lines. Nevertheless, mass analysis is still possible if the island of stability is used. With the negative dc applied to the X rods, the ion motion is described by a<0, λ<0 and the portion of the stability diagram with a<0 should be considered. Thus the upper stability tip of the island with a>0 becomes the lower tip of the stability island. To avoid confusion we will refer to the tips with greater |a| and lesser |a|.

Figure 22:
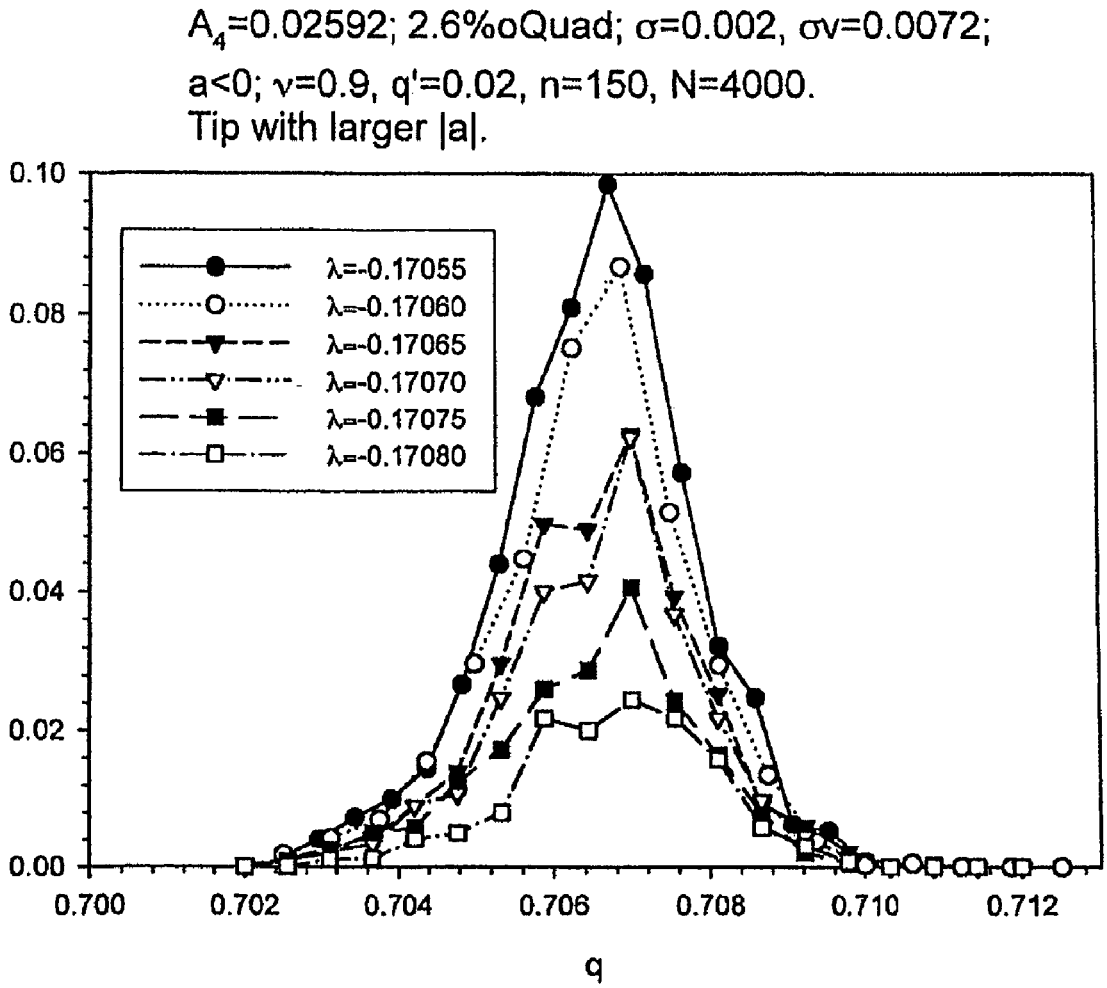

FIG. 22 shows mass analysis at the tip of the stability island with the greater |a|. As the magnitude of λ increases from 0.17055 to 0.17080 the resolution decreases. This is accompanied by a decrease in transmission. The peak with λ=0.17080 has undesirable structure.

Figure 23:
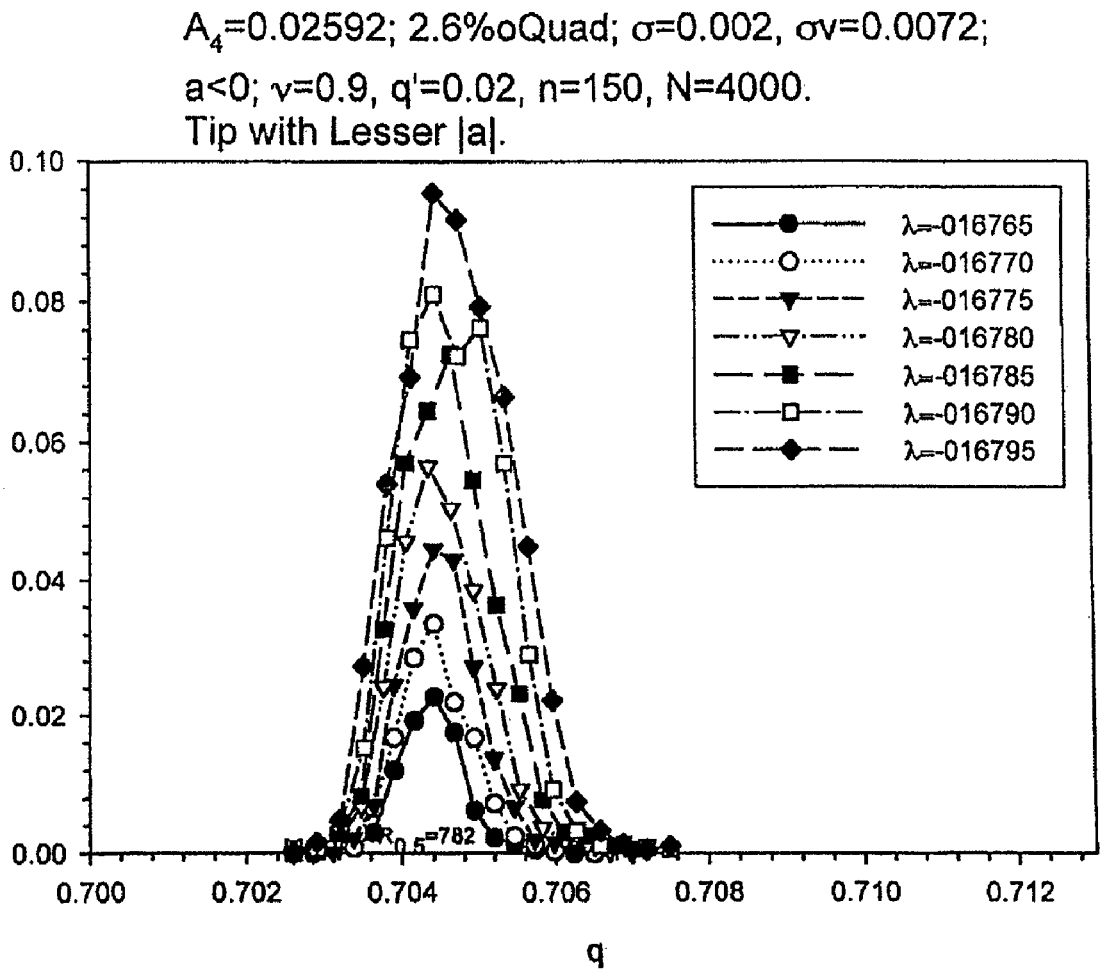

FIG. 23 shows peak shapes when the tip of the stability island with the lesser |a| is used. As the magnitude of λ increases from 0.16765 to 0.16795, resolution improves. The peaks with λ equal to −0.016790 and −0.16795 do not have structure or excessive tails. Thus even when the boundaries of the stability diagram are severely perturbed by applying the dc with the "wrong" polarity, mass analysis is possible provided the tip of the stability boundary with the lesser |a| is used. At this tip the boundaries are formed by the resonant excitation, and these apparently remain sufficiently sharp to provide mass analysis.

Other variations and modifications of the invention are possible. All such modifications or variations are believed to be within the sphere and scope of the invention as defined by the claims appended hereto.

The invention claimed is:

1. A method of processing ions in a quadrupole rod set, the method comprising a) establishing and maintaining a two-dimensional substantially quadrupole field for processing the ions, the field having a quadrupole harmonic with amplitude $A_2$ and a selected higher order harmonic with amplitude $A_m$ wherein m is an integer greater than 2, and the magnitude of $A_m$ is greater than 0.1% of the magnitude of $A_2$;

b) introducing the ions to the two-dimensional substantially quadrupole field and subjecting the ions to both the quadrupole harmonic and the higher order harmonic of the field to radially confine ions having Mathieu parameters a and q within a stability region defined in terms of the Mathieu parameters a and q;

c) adding an auxiliary excitation field to transform the stability region into a plurality of smaller stability islands defined in terms of the Mathieu parameters a and q; and, d) adjusting the two-dimensional substantially quadrupole field including the auxiliary excitation field to place ions within a selected range of mass-to-charge ratios within a selected stability island in the plurality of stability islands to impart stable trajectories to the selected ions within the selected range of mass-to-charge ratios for transmission through the rod set, and to impart unstable trajectories to unselected ions outside of the selected range of mass-to-charge ratios to filter out such ions.

2. The method as defined in claim 1 wherein the selected higher order harmonic with amplitude $A_m$ is one of (i) a hexapole harmonic such that $A_m$ is $A_3$, and (ii) an octopole harmonic such that $A_m$ is $A_4$.

3. The method as defined in claim 2 wherein the rod set comprises a plurality of substantially cylindrical rods.

4. The method as defined in claim 2 further comprising passing the selected ions through the quadrupole rod set and subsequently detecting the selected ions.

5. The method as defined in claim 2 wherein the magnitude of $A_m$ is greater than 1% and is less than 20% of the magnitude of $A_2$.

6. The method as defined in claim 2 wherein the magnitude of $A_m$ is greater than 1% and is less than 10% of the magnitude of $A_2$.

7. The method as defined in claim 2, wherein the auxiliary excitation field is an auxiliary quadrupole excitation field.

8. The method as defined in claim 7, wherein the rod set comprises:

a quadrupole axis;

a first pair of rods, wherein each rod in the first pair of rods is spaced from and extends alongside the quadrupole axis; and a second pair of rods, wherein each rod in the second pair of rods is spaced from and extends alongside the quadrupole axis.

9. The method as defined in claim 8, wherein step (a) comprises providing an at least partially-AC potential difference between the first pair of rods and the second pair of rods at a selected frequency to provide the two-dimensional substantially quadrupole field.

10. The method as defined in claim 9, wherein step c) comprises i) determining an excitation frequency of the auxiliary excitation field as a function of the selected frequency, and ii) providing the auxiliary excitation field at the auxiliary excitation frequency.

11. The method as defined in claim 10 wherein step c) i) comprises determining the excitation frequency to be N/M times the selected frequency, N and M being different integers.

12. The method as defined in claim 11 wherein step d) comprises determining the selected stability island to have a highest magnitude of the Mathieu parameter a in the plurality of stability islands.

13. The method as defined in claim 12 wherein step d) comprises determining a tip in the selected stability island, the tip being selected to have the highest magnitude of the Mathieu parameter a in the selected stability island, and then adjusting the two-dimensional substantially quadrupole field to place the selected ions within the tip.

14. The method as defined in claim 12 wherein step d) comprises determining a tip in the selected stability island, the tip being selected to have a lowest magnitude of the Mathieu parameter a in the selected stability island, and then adjusting the two-dimensional substantially quadrupole field to place the selected ions within the tip.

* * * * *